US008003555B2

(12) United States Patent
Tanaka et al.

(10) Patent No.: US 8,003,555 B2
(45) Date of Patent: Aug. 23, 2011

(54) FLAME RETARDANT SYNTHETIC FIBER, FLAME RETARDANT FIBER COMPOSITE, PRODUCTION METHOD THEREFOR AND TEXTILE PRODUCT

(75) Inventors: Takeshi Tanaka, Hyogo (JP); Hiroyasu Hagi, Hyogo (JP); Toshiaki Ebisu, Hyogo (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 12/506,647

(22) Filed: Jul. 21, 2009

(65) Prior Publication Data

US 2010/0029156 A1 Feb. 4, 2010

Related U.S. Application Data

(63) Continuation of application No. PCT/JP2008/065832, filed on Sep. 3, 2008, and a continuation of application No. PCT/JP2009/062454, filed on Jul. 8, 2009.

(60) Provisional application No. 61/137,062, filed on Jul. 25, 2008, provisional application No. 61/197,422, filed on Oct. 27, 2008.

(30) Foreign Application Priority Data

Jul. 24, 2008 (JP) ..... 2008-191311
Oct. 24, 2008 (JP) ..... 2008-274490

(51) Int. Cl.
*D04H 1/00* (2006.01)
*B32B 25/02* (2006.01)

(52) U.S. Cl. ..... 442/414; 428/296.7; 428/299.7; 428/300.4; 442/361

(58) Field of Classification Search ..... 428/296.7, 428/299.7, 300.4; 442/414
See application file for complete search history.

(56) References Cited

U.S. PATENT DOCUMENTS 4,007,232 A 2/1977 Yamazaki et al.

(Continued)

FOREIGN PATENT DOCUMENTS

JP 51-82023 7/1976

(Continued)

OTHER PUBLICATIONS

International Search Report (Form PCT/ISA/210) issued in corresponding International Application No. PCT/JP2008/065832, issued by the Japanese Patent Office, mailed Dec. 22, 2008 with its English Translation—5 pages.

(Continued)

*Primary Examiner* — Lynda Salvatore
(74) *Attorney, Agent, or Firm* — Hamre, Schumann, Mueller & Larson, P.C.

(57) ABSTRACT

A flame retardant synthetic fiber and a flame retardant fiber composite that satisfy high flame retardance and high fire resistance, a method for producing the flame retardant synthetic fiber and the flame retardant fiber composite, and a textile product are provided. The flame retardant synthetic fiber of the present invention includes a polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer, and at least one kind of a metal compound (2) that accelerates a dehalogenation reaction of the polymer (1) during burning and a carbonization reaction of the polymer (1) during burning, wherein the flame retardant synthetic fiber has a shrinkage variation of 45% or less when a temperature is raised from 50° C. to 300° C. under a load of 0.0054 mN/dtex.

21 Claims, 8 Drawing Sheets

U.S. PATENT DOCUMENTS

| | | | |
|---|---|---|---|
| 4,863,797 | A | 9/1989 | Ichibori et al. |
| 7,259,117 | B2 | 8/2007 | Mater et al. |
| 7,365,032 | B1 | 4/2008 | Adachi et al. |
| 2002/0122937 | A1 | 9/2002 | Sudo et al. |
| 2005/0113501 | A1 | 5/2005 | Nishino et al. |
| 2007/0215847 | A1 | 9/2007 | Nishiura et al. |
| 2007/0237953 | A1 | 10/2007 | Ebisu et al. |

FOREIGN PATENT DOCUMENTS

| | | |
|---|---|---|
| JP | 53-106825 | 9/1978 |
| JP | 58-156014 | 9/1983 |
| JP | 61-89339 | 5/1986 |
| JP | 61-282420 | 12/1986 |
| JP | 6-287806 | 10/1994 |
| JP | 2003-96619 | 4/2003 |
| JP | 2004-197255 | 7/2004 |
| JP | 2005-179876 | 7/2005 |
| JP | 2006-225805 | 8/2006 |
| JP | 2007-291570 | 11/2007 |
| WO | 00/70133 | 11/2000 |
| WO | 01/32968 | 5/2001 |

OTHER PUBLICATIONS

Written Opinion of the International Searching Authority (Form PCT/ISA/237) issued in corresponding International Application No. PCT/JP2008/065832, issued by the Japanese Patent Office, mailed Dec. 22, 2008 with its English Translation—5 pages.

FLAME RETARDANT SYNTHETIC FIBER, FLAME RETARDANT FIBER COMPOSITE, PRODUCTION METHOD THEREFOR AND TEXTILE PRODUCT

BACKGROUND OF THE INVENTION

1. Field of the Invention

The present invention relates to a flame retardant synthetic fiber and a flame retardant fiber composite having high flame retardance, which can be employed preferably for textile products requiring high flame retardance used in bedding, furniture, etc. due to the expression of very high carbonization, shape holding property, and self-extinguishing property during burning, a production method therefor, and a textile product.

2. Related Background Art

Recently, there is an increasing demand for ensuring the safety of food, clothing and shelter, and the necessity for flame retardant materials is increasing from the viewpoint of flame proofing. Under such circumstances, particularly, in order to prevent fire during sleeping, which causes serious human damage when it occurs, the necessity for providing flame retardance to materials to be used in bedding, furniture, etc. is increasing.

In upholstered products such as bedding and furniture, inflammable materials such as cotton, polyester, and urethane foam are used frequently inside of and on the surfaces of the upholstered products for the purpose of comfort during use and design. For ensuring the flame retardance thereof, it is important to use appropriate flame retardant materials in these products to provide high flame retardance for preventing inflammation of the inflammable materials for a long period of time. Further, the flame retardant materials also need to maintain the comfort and design of the products such as bedding and furniture.

As a flame retardant fiber material that is a flame retardant material using fibers, various flame retardant fibers and flame proofing agents have been considered in the past. However, flame retardant fiber materials have not been found that sufficiently satisfy the following requirements: high flame retardance, and comfort and design required of the products such as bedding and furniture.

For example, regarding cotton, there is a procedure such as a so-called post-processed flame proofing in which the cotton is coated with a flame proofing agent. However, the post-processed flame proofing has problems related to the uniformity of the adhesion of a flame proofing agent, the hardening of cloth caused by the adhesion of a flame proofing agent, the elimination of a flame proofing agent caused by washing, the safety, and the like.

Further, polyester-based fibers that are an inexpensive material are melted during burning. Therefore, when fabric is formed of only polyester-based fibers, the fabric will have a hole during burning, which makes it difficult to maintain a configuration, and the above-mentioned cotton or urethane foam used in bedding or furniture is ignited. Thus, the polyester-based fibers have insufficient performance. There also are flame retardant polyester fibers containing phosphorus atoms and the like; however, the behavior of the flame retardant polyester fibers containing phosphorus atoms and the like during burning is similar to the one described above, and hence, the flame retardant polyester fibers containing phosphorus atoms and the like are melted finally, which is insufficient performance.

With a method for obtaining high flame retardant modacrylic fibers by adding antimony trioxide, antimony pentoxide, and magnesium oxide to a spinning dope solution, although the fibers thus obtained can be provided with fire retardance, they do not satisfy a shielding property with respect to flame and heat. As fibers having these performances, i.e., providing flame retardance and satisfying a shielding property with respect to flame and heat, there are cross-linking high flame retardant acrylic fibers with a polymer containing glycidylmethacrylate added thereto (JP 2005-179876 A). However, when the cross-linking high flame retardant acrylic fibers with a polymer containing glycidylmethacrylate added thereto are exposed to strong flame such as burner flame, the fibers are decomposed so that flame passes therethrough finally.

Further, there are high flame retardant shielding modacrylic fibers with solid-phase flame retardants such as water glass and zinc oxide added thereto (JP 2006-225805A). These fibers are excellent in an extinguishing property and flame shielding performance; however, a carbonized layer to be formed during burning is hard, and the shrinkage variation of the fibers is large depending upon the kind of furniture and bedding and the shape of a burnt portion. Therefore, a stress is applied to the carbonized layer formed during burning, and cracks may be generated in the carbonized layer and a hole may be opened in the carbonized layer even under a small load. In order to solve this problem, modacrylic fibers have been proposed, in which zinc oxide and a condensed phosphate-based compound are added to control the carbonizing speed during shrinkage, whereby cracks are unlikely to be generated (JP 2007-291570 A). When these fibers are used, high flame retardance cannot be obtained unless a plurality of limited kinds of fibers are used with a further limited fiber mixed ratio.

Further, a production method for obtaining acrylic synthetic fibers with satisfactory heat resistance and shrinkage by performing a wet-heat stretched heat treatment has been proposed (JP 58 (1983)-156014 A). However, a residual shrinkage stress cannot be removed sufficiently since a heat treatment is performed in a stretched state, and the fibers shrink remarkably at a high temperature of 200° C. or higher such as that of flame although the shrinkage can be suppressed at a relatively low temperature of 160° C. As a result, the fibers to be obtained have degraded flame retardance. Further, the use with other fibers required as a practical textile product is not considered at all, so that the fibers to be obtained cannot withstand the use as a practical flame retardant material.

A flame retardant fiber mixture in which halogen-containing fibers that are made highly flame retardant by the addition of a large amount of a flame retardant are combined with non-flame retardant fibers (JP 61 (1986)-89339 A), and bulky flame retardant nonwoven fabric composed of fibers that are essentially flame retardant, halogen-containing fibers, and the like (U.S. Pat. No. 7,259,117) have been proposed respectively.

However, according to these methods, the shapes before burning such as fabric and woven fabric cannot be maintained during burning, so that desired flame retardance, in particular, a flame shielding property cannot be ensured; high flame retardance is not obtained unless a plurality of limited kinds of fibers are used with a further limited fiber mixed ratio, which causes trouble in terms of a product design and production steps. Although, generally, heat-resistant fibers and fibers that are essentially flame retardant are likely to have desired flame retardance, the fibers are hard and brittle in most cases, so that it is very difficult to handle the fibers in the course of production and processing of texture and the costs are high. Also, high flame retardance cannot be obtained without a further limited fiber mixed ratio, which causes trouble in terms of a product design and production steps.

SUMMARYY OF THE INVENTION

In order to solve the above conventional problems, the present invention provides a flame retardant synthetic fiber and a flame retardant fiber composite that satisfy high flame retardance and a high shielding property, a production method therefor, and a textile product.

Aflame retardant synthetic fiber of the present invention, includes: a polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer; and at least one kind of a metal compound (2) that accelerates a dehalogenation reaction of the polymer (1) during burning and a carbonization reaction of the polymer (1) during burning, wherein the flame retardant synthetic fiber has a shrinkage variation of 45% or less when a temperature is raised from 50° C. to 300° C. under a load of 0.0054 mN/dtex.

A method for producing a flame retardant synthetic fiber of the present invention, includes spinning a composition that contains a polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer and that contains at least one kind of a metal compound (2) that accelerates a dehalogenation reaction of the polymer (1) during burning and a carbonization reaction of the polymer (1) during burning, followed by heat treatment, thereby obtaining a flame retardant synthetic fiber that has a shrinkage variation of 45% or less when a temperature is raised from 50° C. to 300° C. under a load of 0.0054 mN/dtex.

The flame retardant fiber composite of the present invention contains the flame retardant synthetic fiber of the present invention. Further, it is preferred that the flame retardant fiber composite of the present invention is a flame retardant fiber mixture containing 10% by mass or more of the flame retardant synthetic fiber of the present invention, and 90% by mass or less of at least one kind of a fiber selected from the group consisting of a natural fiber, a regenerated fiber, and a synthetic fiber other than the flame retardant synthetic fiber of the present invention.

A method for producing a flame retardant fiber composite of the present invention is characterized by producing the flame retardant fiber composite of the present invention.

A textile product of the present invention is characterized by containing the flame retardant fiber composite of the present invention.

According to the present invention, a textile product having high flame retardance and a high flame shielding property can be obtained.

DETAILED DESCRIPTION OF THE INVENTION

Figure 1:
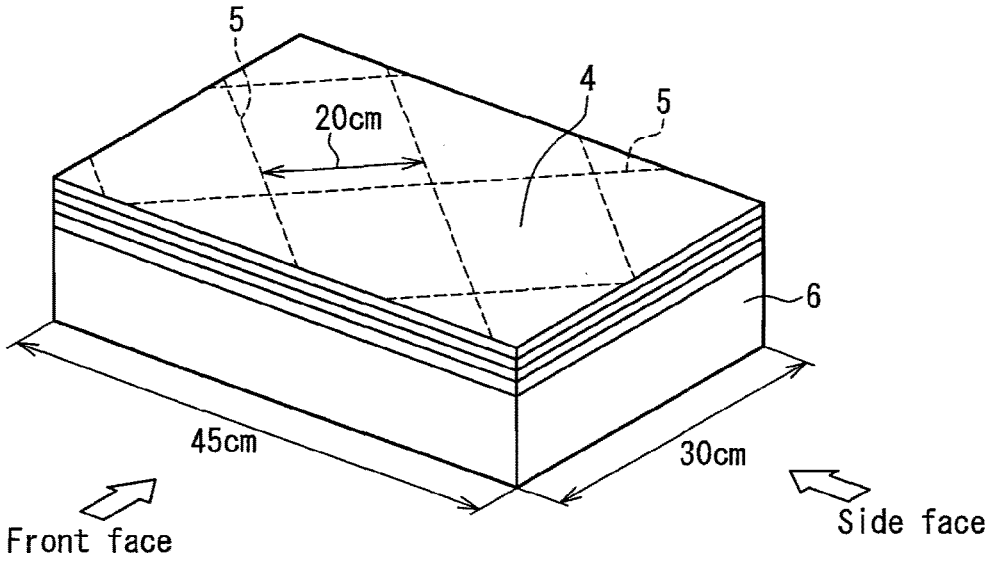
FIG. 1 is a general view showing a configuration of a test body for evaluating flame retardance in one example of the present invention.

The inventors of the present invention earnestly studied so as to solve the above problems. As a result, the inventors found the following: high flame retardance can be obtained by allowing a synthetic fiber containing acrylonitrile, a halogen-containing vinylidene, and/or a halogen-containing vinyl monomer to contain at least one kind of a metal compound that accelerates a dehalogenation reaction and a carbonization reaction so that the shrinkage variation is 45% or less when a temperature is raised from 50° C. to 300° C. under a load of 0.0054 mN/dtex, and thus, achieved the present invention. Further, the inventors of the present invention found the following: the shrinkage variation becomes 45% or less when a temperature is raised from 50° C. to 300° C. under a load of 0.0054 mN/dtex by decreasing the strength of a flame retardant synthetic fiber and increasing an elongation, whereby high flame retardance can be obtained, and thus, achieved the present invention.

A polymer (1) of the present invention contains 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer. "The polymer (1) of the present invention contains 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer" means that the polymer (1) contains 30 to 70% by mass of acrylonitrile, 70 to 30% by mass of a halogen-containing vinylidene monomer and/or a halogen-containing vinyl monomer, and 0 to 10% by mass of a vinyl-based monomer copolymerizable therewith, based on the total mass of the polymer (1). When the content of acrylonitrile is 30 to 70 parts by mass, the heat resistance required for fiberization is obtained and the flame retardance also can be achieved. The preferred content of acrylonitrile is 40 to 60 parts by mass, and in this range, fibers are colored less. Further, it is more preferred that the content of acrylonitrile is 40 to 46 parts by mass, since the heat treatment can be performed at a low temperature for a short period of time. It is more preferred that the content of acrylonitrile is 50 to 60 parts by mass, since fibers are colored even less.

Examples of the polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer include but are not limited to polymers of at least one kind of a halogen-containing vinylidene-based monomer such as acrylonitrile-vinylidene chloride and acrylonitrile-vinylidene chloride-vinylidene fluoride, and acrylonitrile; and copolymers of at least one kind of a halogen-containing vinylidene-based monomer such as vinylidene chloride, vinylidene bromide and vinylidene fluoride, acrylonitrile, and a vinyl-based monomer copolymerizable therewith. Further, at least one kind of the above-mentioned copolymers may be mixed appropriately.

Examples of the vinyl-based monomer copolymerizable therewith include acrylic acid and an ester thereof, methacrylic add and an ester thereof, acrylamide, methacrylamide, vinyl acetate, vinylsulfonic add and a salt thereof, methacryl sulfonic acid and a salt thereof, styrene sulfonic acid and a salt thereof, and 2-acrylamide-2-methyl sulfonic acid and a salt thereof. One kind or at least two kinds of them are used. Further, it is preferred that at least one kind of them is a vinyl-based monomer containing a sulfo group, since dyability is enhanced.

Specific examples of the polymer (1) containing 30 to 70 parts by mass of acrylonitrile, 70 to 30 parts by mass of a halogen-containing vinylidene monomer, and 0 to 10 parts by mass of a vinyl-based monomer copolymerizable therewith, based on 100 parts by mass of the polymer, include the following polymers:

(1) a copolymer containing 51 parts by mass of acrylonitrile, 48 parts by mass of vinylidene chloride, and one part by mass of sodium styrenesulfonate;

(2) a copolymer containing 43 parts by mass of acrylonitrile, 56.1 parts by mass of vinylidene chloride, and 0.9 parts by mass of sodium 2-acrylamido-2-methylpropanesulfonate;

(3) a copolymer containing 57 parts by mass of acrylonitrile, 41 parts by mass of vinylidene chloride, and 2 parts by mass of sodium allylsulfonate;

(4) a copolymer containing 60 parts by mass of acrylonitrile, 30 parts by mass of vinylidene chloride, and 10 parts by mass of sodium 2-acrylamido-2-methylpropanesulfonate;

(5) a copolymer containing 55 parts by mass of acrylonitrile, 43 parts by mass of vinylidene chloride, and 2 parts by mass of sodium methallylsulfonate;

(6) a mixture in which a copolymer containing 69 parts by mass of acrylonitrile, 16 parts by mass of vinylidene chloride, and 15 parts by mass of sodium 2-acrylamido-2-methylpropanesulfonate is mixed with a copolymer containing 58 parts by mass of acrylonitrile and 42 parts by mass of vinylidene chloride in a mass ratio of 1/10 (in a mixed system, 59 parts by mass of acrylonitrile, 39.6 parts by mass of vinylidene chloride, and 1.4 parts by mass of sodium 2-acrylamido-2-methylpropanesulfonate); and (7) a copolymer containing 56 parts by mass of acrylonitrile, 42 parts by mass of vinylidene chloride, and 2 parts by mass of sodium 2-acrylamido-2-methylpropanesulfonate.

The copolymer can be obtained by a known polymerization method. Examples of the polymerization process include but are not limited to bulk polymerization, suspension polymerization, emulsion polymerization, and solution polymerization, and examples of the polymerization form include but are not limited to a continuous type, a batch type, and a semibatch type. Of those, the emulsion polymerization and the solution polymerization are preferred as the polymerization system, and the continuous type and the semibatch type are preferred as the polymerization form.

As at least one kind of a metal compound (2) that accelerates the dehalogenation reaction of the polymer (1) of the present invention during burning and the carbonization reaction of the polymer (1) of the present invention during burning, a metal compound (2-1) that accelerates both the dehalogenation reaction and the carbonization reaction, selected from zinc oxide, zinc carbonate, zinc sulfide, zinc borate, zinc stannate, metastannic add, tungsten oxide, zirconium oxide, tin oxide, copper oxide, copper phosphate, indium trioxide, barium titanate, and zinc para-toluenesulfonate, or the metal compound (2-1) combined with a metal compound (2-2) that accelerates the dehalogenation reaction, selected from an antimonide, iron oxide, iron phosphate, iron oxalate, iron sulfide, molybdenum oxide, bismuth trioxide, bismuth oxychloride, and copper iodide, can be used.

It is considered that the metal compound (2-1) accelerates the dehalogenation reaction of the polymer (1) during burning and accelerates the generation of polyene to be a precursor of the carbonization reaction during burning, and further, a metal halide generated by the dehalogenation acts on the polyene structure catalytically to accelerate the carbonization. As the metal compound (2-1), a compound that effects the dehalogenation reaction at 200° C. or lower is preferred in terms of the later acceleration of the carbonization. In particular, at least one selected from zinc oxide, zinc stannate, zinc carbonate, and tin oxide is preferred.

The metal compound (2-1) may be used alone or in combination of at least two kinds. Further, the metal compound (2-1) also can be combined with the metal compound (2-2) that accelerates the dehalogenation reaction of the polymer (1) during burning, selected from an antimonide, iron oxide, iron phosphate, iron oxalate, iron sulfide, molybdenum oxide, bismuth trioxide, bismuth oxychloride, and copper iodide. The metal compound (2-2) that accelerates the dehalogenation reaction of the polymer (1) accelerates the dehalogenation reaction of the polymer (1), thereby accelerating the generation of polyene to be a precursor of the carbonization reaction. On the other hand, the metal compound (2-2) does not have an ability to accelerate the carbonization from the generated polyene structure, and hence, the single use of the metal compound (2-2) is not effective in the present invention.

As the metal compound (2-2), in particular, an antimonide is preferred. The antimonide accelerates the dehalogenation reaction of the polymer (1) during burning; in addition, an antimony halide generated by the dehalogenation becomes gas in a wide temperature range during burning, and the gas traps a radical to suppress burning, i.e., exhibits an extinguishing ability.

Examples of the antimonide include but are not limited to antimony oxide compounds such as antimony trioxide, antimony tetroxide, and antimony pentoxide; antimonic acid and a salt thereof, and an inorganic antimonide such as antimony oxychloride. These compounds may be combined. Of those, antimony trioxide and antimony pentoxide are preferred in terms of the performance and industrial availability.

The addition amount of the metal compound (2) is preferably 0.05 to 50 parts by mass, based on 100 parts by mass of the polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith. The lower limit value is more preferably 0.1 parts by mass and still more preferably 1 part by mass. Further, the upper limit value is more preferably 40 parts by mass and still more preferably 30 parts by mass. When the use amount of the metal compound (2) is 0.05 to 50 parts by mass, there is an effect of carbonizing a polymer during burning (carbonization effect), which enables a carbonization effect required for obtaining desired high flame retardance to be obtained, whereby a desired shrinkage ratio is obtained. In the preferred range, the effect of the above function is enhanced further.

The addition amount of the metal compound (2-1) is preferably 0.05 to 50 parts by mass, based on 100 parts by mass of the polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith. The lower limit value is more preferably 0.1 parts by mass and still more preferably 1 part by mass. Further, the upper limit value is more preferably 40 parts by mass and still more preferably 30 parts by mass. When the use amount of the metal compound (2-1) is 0.05 to 50 parts by mass, there is an effect of carbonizing a polymer during burning (carbonization effect), which enables a carbonization effect required for obtaining desired high flame retardance to be obtained, whereby a desired shrinkage ratio is obtained. In the preferred range, the effect of the above function is enhanced further.

The addition amount of the metal compound (2-2) is 0 to 50 parts by mass, preferably 3 to 40 parts by mass, and more preferably 5 to 30 parts by mass, based on 100 parts by mass of the polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith. Although desired flame retardance may be achieved even in the case where the addition amount of the metal compound (2-2) is 0 part by mass, it is preferred that 3 parts by mass to 40 parts by mass of the metal compound (2-2) is added in the case of the use in an application requiring a higher self-extinguishing effect due to a low self-distinguishing effect.

The average particle size of the metal compound (2) is preferably 3 μm or less and more preferably 2 μm or less. It is preferred that the average particle size of the metal compound (2) is 3 μm or less in terms of the following points: the prevention of trouble such as nozzle clogging in the process of production of fibers obtained by adding a metal compound component to a halogen-containing polymer, the enhancement of the strength of the fibers, the dispersion of metal compound component particles in the fibers, and the like. Although the lower limit of the average particle size of the metal compound (2) is not particularly limited, the lower limit is preferably 0.01 μm or more and more preferably 0.05 μm or more in terms of a handling property. Further, the metal compound (2) may be modified chemically on the surface of particles so as to enhance a blocking property, or may be used in a state of being dispersed in water or an organic solvent. Herein, the average particle size refers to a median diameter. As a method for measuring a median diameter, a light scattering method can be used.

The flame retardant synthetic fiber of the present invention further contains 0.1 to 20 parts by mass of an epoxy-containing compound, based on 100 parts by mass of the polymer (1). Due to the presence of the epoxy-containing compound, fibers are cross-linked by drying or heat treatment in the process of the production of fibers, and a polymer cross-linking structure is formed in the fibers, whereby the shrinkage of the fibers can be suppressed more.

An example of the epoxy-containing compound includes a polymer containing an epoxy group, and for example, may be a glycidyl ether type, a glycidyl amine type, a glycidyl ester type, an annular aliphatic type, or a copolymer containing them. Considering the elution to a spinning bath and the number of reaction groups (epoxy groups) per unit weight, for example, polyglycidyl methacrylate (weight average molecular weight: 3,000 to 100,000) preferably is used as the glycidyl ester type.

The flame retardant synthetic fiber of the present invention may contain other additives such as an antistatic agent, a thermal discoloration inhibitor, a light resistance improving agent, a whiteness improving agent, a devitrification inhibitor, a coloring agent, and a flame retardant, if required.

In the present invention, the shrinkage variation of the flame retardant synthetic fiber is in a range of 45% or less when a temperature is raised from 50° C. to 300° C. under a load of 0.0054 mN/dtex.

In the above, the shrinkage variation at a time when a temperature is raised from 50° C. to 300° C. refers to the difference between the highest point and the lowest point of a shrinkage in a temperature range from 50° C. to 300° C. The difference necessarily becomes a numerical value of 0 or more. The difference corresponds to a range indicated by an arrow in FIGS. 6 to 12, for example, in the notification of the figure of the present application. A specific description will be provided below.

Figure 6:
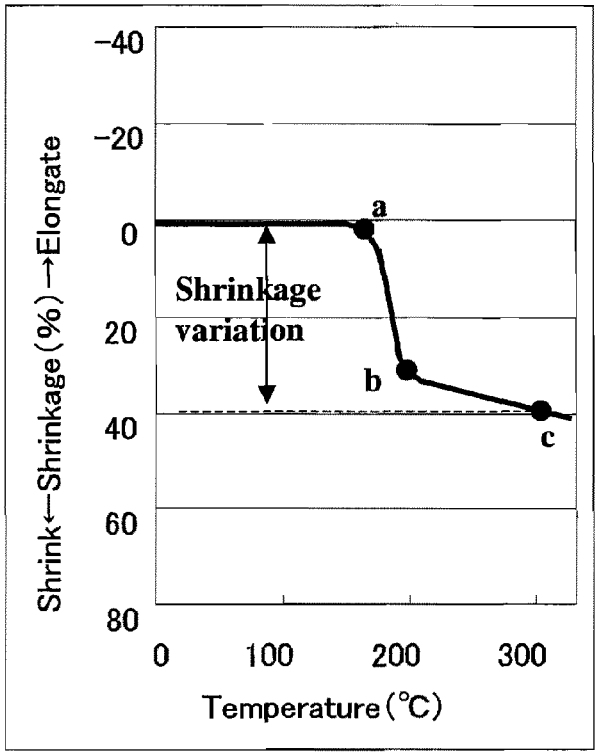
FIG. 6 is a graph showing a shrinkage pattern of a flame retardant synthetic fiber in one example of the present invention.
Figure 8:
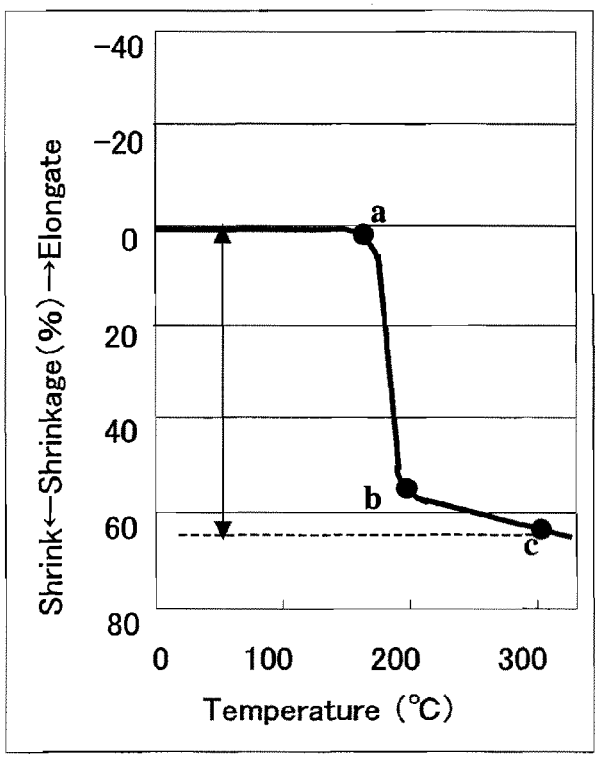
FIG. 8 is a graph showing a shrinkage pattern of a flame retardant synthetic fiber in a comparative example.

1. For example, in the case of monotonic shrinkage along with the increase in temperature as shown in FIGS. 6 and 8, the shrinkage variation becomes a shrinkage at a point c (i.e., 300° C.).

2. In the case where fibers shrink, elongate once, and shrink again as shown in FIGS. 9 to 12, the shrinkage variation is determined depending upon the elongation degree when the fibers elongate: the shrinkage variation is equal to a shrinkage at the point c in FIG. 9; the shrinkage variation is equal to a shrinkage at a point b in FIG. 10; and the shrinkage variation is equal to a shrinkage obtained by subtracting a shrinkage at a point b' from a shrinkage at a point b in FIGS. 11 and 12.

Figure 7:
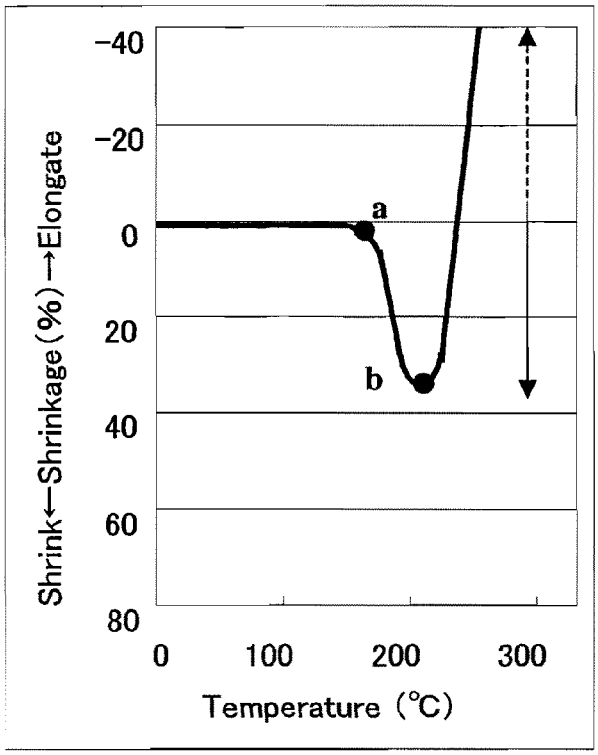
FIG. 7 is a graph showing a shrinkage pattern of a flame retardant synthetic fiber in a comparative example.

3. In the case where fibers shrink, elongate monotonically or elongate to be broken at some midpoint as shown in FIG. 7, the shrinkage variation is equal to a shrinkage indicated by an arrow (in the case where the fibers elongate to be broken, the shrinkage variation is ∞).

4. A point a in the figures refers to a softening start point. Between the points a and b, the shrinkage caused by stress relaxation, the shrinkage caused by dehalogenation, and the "elongation" caused by softening occur, and the shrinkage prevails over the elongation. After the point b, the shrinkage caused the dehalogenation, the shrinkage caused by the carbonization (shape retention), and the "elongation" caused by softening compete with each other, resulting in the following patterns.

(1) When the carbonization ability is excellent, the shrinkage (or shape retention) prevails over the elongation, and shrinkage patterns as shown in FIGS. 6 and 8 are obtained.

(2) When the carbonization ability is shghtly poor, although the elongation prevails in the vicinity of the point b, the carbonization prevails along with the increase in temperature, and the shrinkage starts again at a certain point (point b' in the figures) (FIGS. 9, 10, 11, and 12).

(3) When there is no carbonization ability, the elongation prevails after the point b, resulting in a shrinkage pattern shown in FIG. 7.

Figure 9:
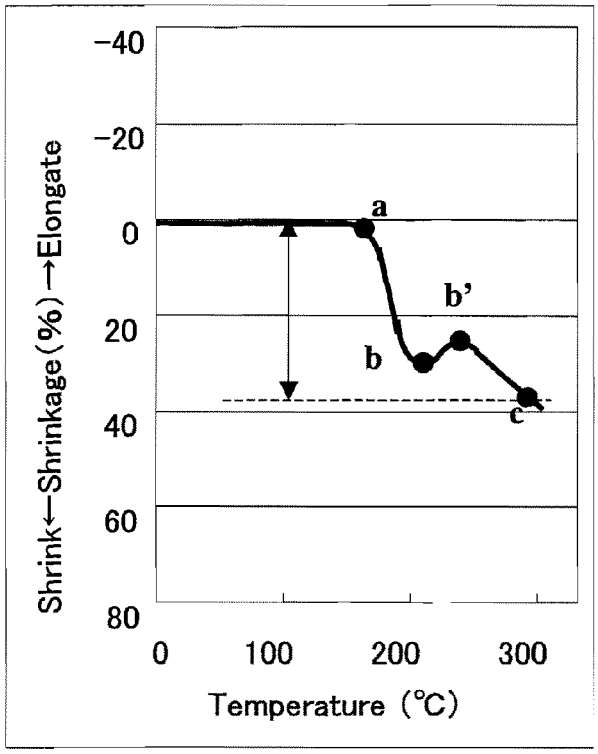
FIG. 9 is a graph showing a shrinkage pattern of a flame retardant synthetic fiber in another example of the present invention.
Figure 10:
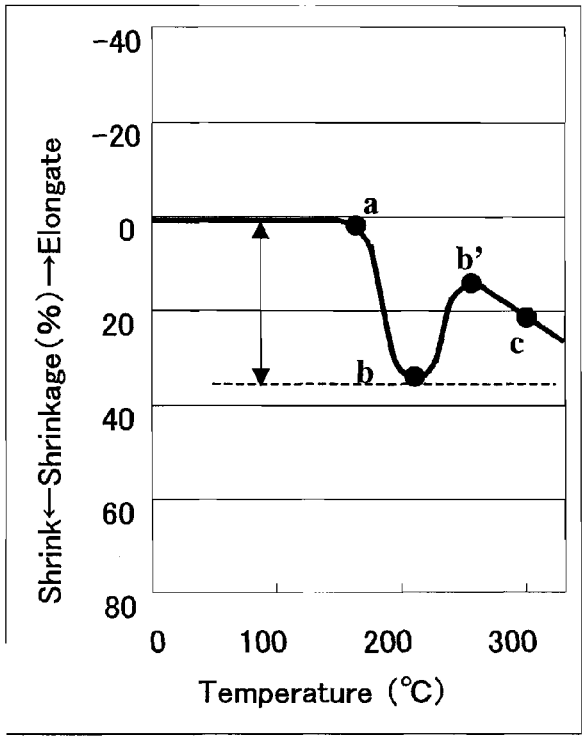
FIG. 10 is a graph showing a shrinkage pattern of a flame retardant synthetic fiber in still another example of the present invention.
Figure 11:
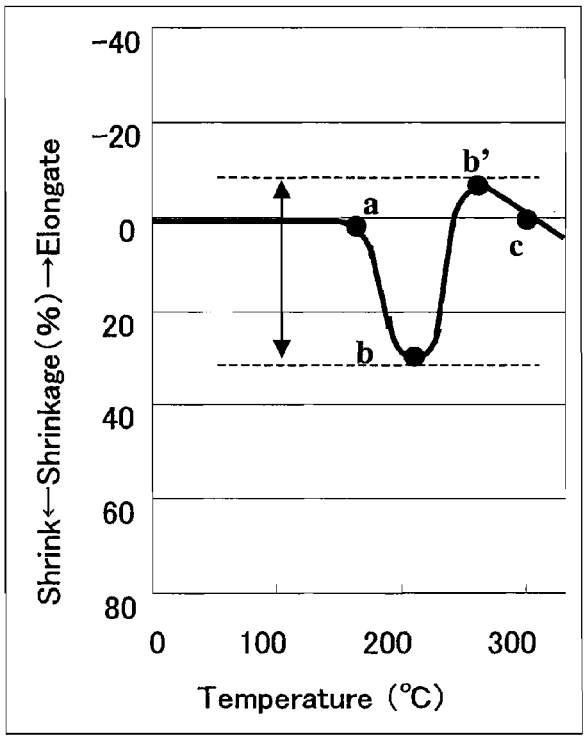
FIG. 11 is a graph showing a shrinkage pattern of a flame retardant synthetic fiber in still another example of the present invention.

5. In the present invention, the flame retardant synthetic fiber of the example has four shrinkage patterns (FIGS. 6, 9, 10, and 11). FIG. 6 shows the most preferred shrinkage pattern of the flame retardant synthetic fiber of the example in the present invention, followed by FIGS. 9, 10, and 11 in this order. The shrinkage pattern shown in FIG. 6 is most preferred, in which the shrinkage caused by the stress relaxation and the shrinkage caused by the dehalogenation are small, the carbonization ability is strong, and monotonic shrinkage occurs. However, the shrinkage patterns as shown in FIGS. 9, 10, and 11 also may be acceptable, in which even if the carbonization ability is slightly poor and the fibers elongate due to the softening before the carbonization, the carbonization occurs again at a certain temperature or higher, whereby the fibers shrink (retain a shape). It should be noted that the shrinkage at the point h' in the figures is more preferably 0% or more. Further, the flame retardant synthetic fiber is carbonized and remains without being broken when a temperature is raised from 50° C. to 300° C. under a load of 0.0054 mN/dtex. In the present invention, the flame retardant synthetic fiber being carbonized and remaining without being broken when a temperature is raised from 50° C. to 300° C. under a load of 0.0054 mN/dtex means that the flame retardant synthetic fiber remains without being broken when a fiber shrinkage is measured by a method for measuring a fiber shrinkage described later while a temperature is raised from 50° C. to 300° C. under a load of 0.0054 mN/dtex.

Figure 12:
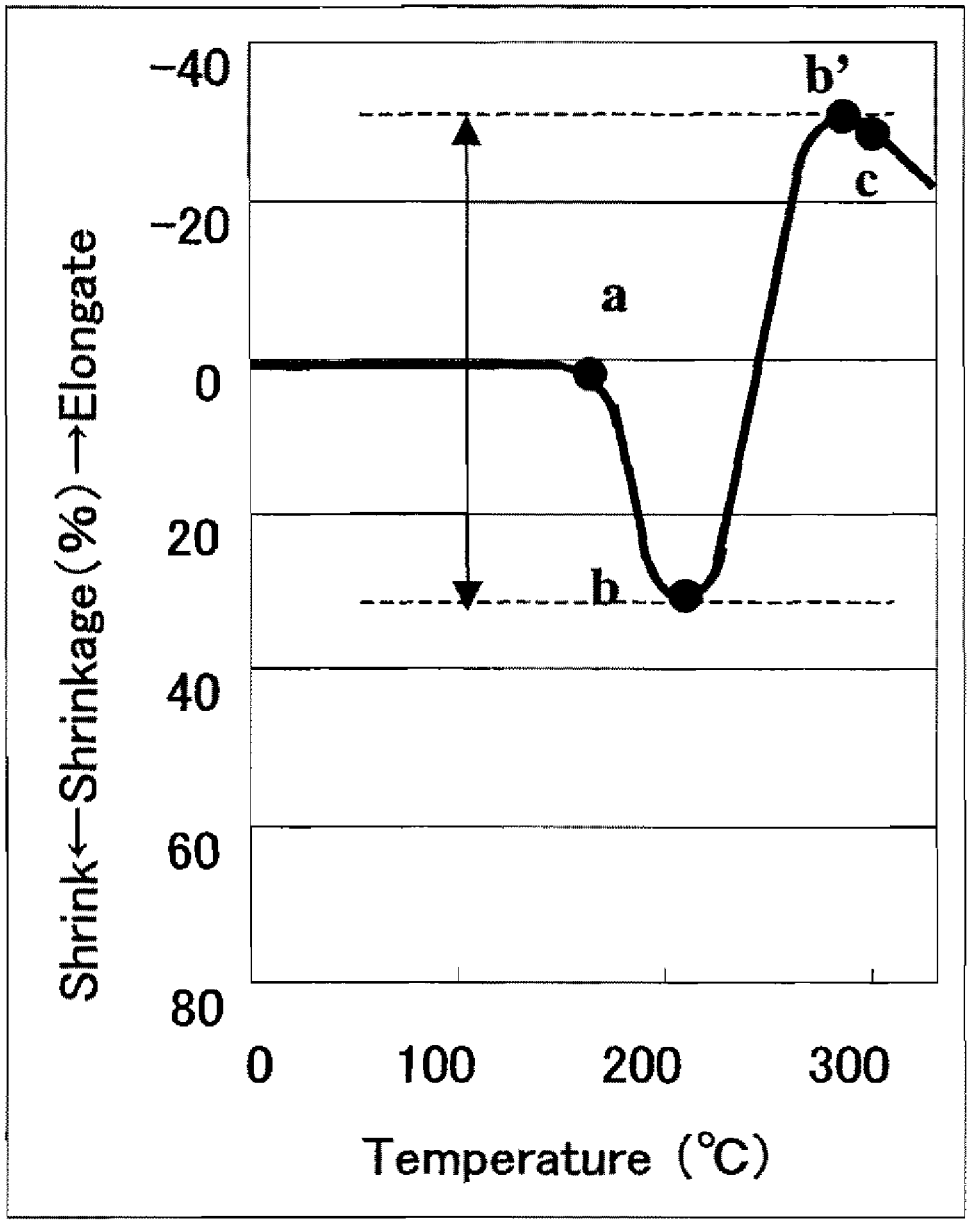
FIG. 12 is a graph showing a shrinkage pattern of a flame retardant synthetic fiber in a comparative example.

6. In contrast, FIGS. 7, 8, and 12 show the shrinkage patterns of fibers in comparative examples. The shrinkage pattern of fibers in the comparative example shown in FIG. 7 is not preferred, since the fibers elongate to the full or are broken when a temperature is raised. In FIG. 8, although the carbonization ability is excellent and monotonic shrinkage occurs along with a temperature, the shrinkage pattern in FIG. 8 is not preferred since the shrinkage caused by stress relaxation (points a to b in the figure) is too large, and the shrinkage variation at a time when a temperature is raised from 50° C. to 300° C. exceeds 45% consequently. FIG. 12 shows the same shrinkage pattern as those of FIGS. 9 and 10; however, the shrinkage pattern in FIG. 12 is not preferred since the carbonization ability is weak, the elongation prevails, and the shrinkage variation (shrinkage at the point b' is subtracted from shrinkage at the point b) exceeds 45%.

In the flame retardant synthetic fiber of the present invention, the filament strength is preferably 0.5 to 1.6 cN/dtex and more preferably 0.5 to 1.1 cN/dtex. Further, the elongation of the flame retardant synthetic fiber of the present invention is preferably 50 to 90% and more preferably 60 to 80%. In the flame retardant synthetic fiber of the present invention, the shrinkage variation is likely to become 45% or less when a temperature is raised from 50° C. to 300° C. under a load of 0.0054 mN/dtex, whereby high flame retardance is obtained. In the present invention, the ifiament strength refers to the one measured according to JIS L 1015, and the elongation refers to the one measured according to JIS L 1015.

The flame retardant synthetic fiber of the present invention may be a short fiber or a long fiber, which can be selected appropriately depending upon the use method. The fineness is selected appropriately depending upon a mixture to be used and the application of a textile product, and is preferably 1 to 50 dtex, more preferably 1.5 to 30 dtex, and still more preferably 1.7 to 15 dtex. The cut length is selected appropriately depending upon the application of a mixture and a textile product. Examples include a short cut fiber (fiber length: 0.1 to 5 mm), a short fiber (fiber length: 38 to 128 mm), or a long fiber (filament) without being cut. Of those, the short fiber with a fiber length of about 38 to 76 nm is preferred. When combined with another fiber, the flame retardant synthetic fiber may have the same fineness as that of another fiber, or may be thinner or thicker than another fiber. The flame retardant synthetic fiber of the present invention can be mixed with another fiber, in particular, a polyester fiber.

the flame retardant mechanism in the flame retardant synthetic fiber of the present invention will be described.

(1) Regarding the Metal Compound (2-1)

For example, zinc oxide is exemplified as the metal compound (2-1). Zinc oxide is considered to have a function of accelerating the dehalogenation reaction of the flame retardant synthetic fiber. Further, it is considered that zinc halide (zinc chloride ($ZnCl_2$) in the case of chlorine) generated by the dehalogenation and dehalogenated hydrogen not only acts on the polyene structure catalytically to accelerate the carbonization (a residue during burning becomes a shape holding component), but also contributes to a triazine ring formation reaction (fibers shrink due to cyclization) of acrylonitrile. Such effects are exhibited not only by zinc oxide but also by other zinc compounds, an organic zinc compound such as zinc carbamate and zinc octoate, or a part of metal oxides such as tin oxide and copper oxide. Further, a carbide generated as a result of the function of accelerating carbonization and cychzation of the metal compound (2-1) is strong, and enables the formation of a residue, in particular, a residue holding a fiber form. In the case of exposing to flame a mixture in fabric, nonwoven fabric or the like using fibers, in which a residue formed during heating remains, in particular a residue holding a fiber form, the flame can be shielded with the residue.

(2) Regarding the Setting of the Shrinkage Variation to be 45% or Less when a Temperature is Raised from 50° C. to 300° C. Under a Load of 0.0054 mN/dtex Generally, a halogen-containing fiber exhibits behavior of shrinkage once during heating (burning), and thereafter elongating. As the factors for shrinkage during heating (burning), two factors: a. shrinkage caused by carbonization and b. shrinkage caused by spinning residual stress are considered. Of those, a. shrinkage caused by carbonization is ascribed to the dehalogenation from a copolymer and the triazine ring formation of acrylonitrile. This is a chemical reaction derived from a copolymer composition, and it is difficult to suppress the shrinkage caused by this reaction. On the other hand, b. shrinkage caused by spinning residual shrinkage stress is ascribed to the coagulation during a fiber production process and the residual strain given to fibers during a stretching operation, and such shrinkage can be suppressed by appropriately selecting production conditions of fibers, in particular, heat treatment conditions during a fiber production process. Examples of the heat treatment method include relaxation heat treatment, stretched heat treatment at a wet-heating of 150° C. or higher, and a stretched heat treatment at a dry-heating of 180° C. or higher. Of those, as the heat treatment method suppressing a spinning residual stress sufficiently, a relaxation heat treatment is preferred. By performing these heat treatments, a spinning residual shrinkage stress can be suppressed, and a shrinkage variation during heating (burning), i.e., a shrinkage variation can be set to be 45% or less when a temperature is raised from 50° C. to 300° C. under a load of 0.0054 mN/dtex. When the shrinkage variation is 45% or less when a temperature is raised from 50° C. to 300° C. under a load of 0.0054 mN/dtex, high flame retardance and high fire resistance are expressed. This is preferred for the following reason. For example, in a burning test 16CFR1633 of a bed in the U.S., the fiber shrinkage is suppressed during burning, and therefore, there is no case in which a hole is opened in a portion exposed to flame and/or cracks are formed due to strain, which would allow flame to enter through the cracks to ignite an internal inflammable structure, and result in a fail in the test. The shrinkage variation at a time when a temperature is raised from 50° C. to 300° C. under a load of 0.0054 mN/dtex is preferably 40% or less and particularly preferably 35% or less in terms of the expression of higher flame retardance and high fire resistance. The shrinkage variation at a time when a temperature is raised from 50° C. to 300° C. under a load of 0.0054 mN/dtex is preferably as small as possible, and preferably closer to 0%. Further, when a temperature is raised from 50° C. to 300° C. under a load of 0.0054 mN/dtex, it is preferred that fibers are carbonized and remain without being broken. In the flame retardant synthetic fiber of the present invention, there is a small difference between a softening temperature and a dehalogenation start temperature (decomposition point). Therefore, when a heat treatment temperature is raised, fibers are colored due to the dehalogenation reaction, or it may be difficult to provide sufficient heat treatment. As measures for solving this problem, there is a procedure for decreasing the content of acrylonitrile of the flame retardant synthetic fiber of the present invention to lower the softening point thereof. According to this procedure, a heat treatment temperature can be set to be a decomposition temperature or lower. Under pressure wet-heat conditions, a sufficient heat treatment can be performed even at a softening point or lower.

(3) Regarding the Mechanism of Suppressing the Shrinkage of a Polymer Containing an Epoxy Group (Polyglycidylmethacrylate (pGMA) as an Example)

The shrinkage is suppressed by allowing pGMA to react in a spinning process and introducing a polymer cross-linking structure into fibers. The pGMA is cross-linked with heat from drying or heat treatment, and the cross-linking is considered to proceed further in the presence of an acid catalyst. Metal oxides (antimony trioxide ($Sb_2O_3$), zinc oxide (ZnO)) contained in the flame retardant synthetic fiber of the present invention react with halogens in polymers contained in the fibers to become halides ($SbCl_3$, $ZnCl_2$ in the case of chlorine), which is considered to accelerate the cross-lining of the pGMA as acid catalysts.

The flame retardant synthetic fiber of the present invention can be produced by spinning a composition that contains a polymer containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer, and at least one kind of a metal compound that accelerates the dehalogenation reaction during burning and the carbonization reaction during burning, and thereafter, performing heat treatment. Specifically, the flame retardant synthetic fiber of the present invention can be produced by a known method such as a wet spinning method, a dry spinning method, or a semi-dry and semi-wet method. For example, according to the wet spinning method, the above polymer is dissolved in a solvent such as N,N-dimethylformamide, N,N-dimethylacetoamide, actone, a rhodan salt aqueous solution, dimethyl sulfoxide, or a nitric acid aqueous solution, and extruded to a coagulation bath through a nozzle to be coagulated, followed by stretching, washing with water, drying, heat treatment, and crimping, if required, and is cut to obtain a product. As the solvent, N,N-dimethylformamide, N,N-dimethylacetoamide, and acetone are preferred, and further, N,N-dimethylformamide and acetone are preferred since they can be handled industrially.

If the shrinkage variation at a time when a temperature is raised from 50° C. to 300° C. under a load of 0.0054 mN/dtex is in a range of 45% or less, stretching may be performed before the heat treatment after spinning twist. That is, the flame retardant synthetic fiber of the present invention may be produced by extruding a spinning solution containing the above composition (spinning twist), subjecting the extruded spinning solution to primary stretching and washing with water, followed by drying, secondary stretching, and heat treatment. In the present invention, the primary stretching refers to an operation in which fibers are stretched in a fiber production step (spinning step) after spinning twist and before drying. The secondary stretching refers to an operation in which fibers are stretched in a spinning step from drying to heat treatment. The primary stretching may be performed in any step as long as it is performed before the drying step, and for example, the primary stretching may be performed before washing with water, during washing with water, after washing with water, or continuously from a time during washing with water to a time after washing water.

In the production of the flame retardant synthetic fiber of the present invention, a total stretching ratio (times) (stretching ratio (times)×relaxation ratio (times)) obtained by multiplying a stretching ratio (times) by a relaxation ratio (times) is preferably less than 4.5 times, more preferably less than 4.1 times, and particularly preferably 3.2 times or less. Thus, a spinning residual shrinkage stress can be suppressed further, and higher flame retardance can be obtained. Further, the total stretching ratio (times) is preferably 0.1 times or more, and more preferably 1.0 time or more.

In the present invention, the stretching ratio (times) refers to a ratio at which the length of fibers is stretched in the fiber production step (spinning step) before the heat treatment. The spinning step before the heat treatment includes, for example, a coagulation step (extrusion of a spinning solution), a water-washing step (including the case of stretching during washing with water), a drying step, and a stretching step. Assuming the treatment in which the length of fibers becomes constant, e.g., lines of thread (bundle of fibers) move between two rollers, the stretching ratio is 1.0 time when an inside roller speed is the same as that of an outside roller speed. Assuming the treatment in which the length of fibers becomes three times, e.g., lines of thread (bundle of fibers) move between two rollers, the stretching ratio is 3.0 times when an outside roller speed is three times that of an inside roller speed. The stretching ratio is not particularly limited; however, the stretching ratio is preferably 1.0 to 10.0 times, considering the productivity of fibers, the expression of fiber strength, and the setting of the shrinkage variation to be 45% or less when a temperature is raised from 50° C. to 300° C. under a load of 0.0054 mN/dtex. Further, the lower limit value of the stretching ratio is more preferably 2.0 times and particularly preferably 3.0 times, and the upper limit value thereof is more preferably 9.0 times and particularly preferably 8.0 times. Further, in the case where the stretching is performed a plurality of times in a plurality of spinning steps before the heat treatment, the stretching ratio in the present invention is obtained by multiplying the stretching ratios in respective stretching steps. For example, as described above, in the case where the primary stretching and the secondary stretching are performed in the fiber production step, the stretching ratio is obtained by multiplying the primary stretching ratio by the secondary stretching ratio. In this case, if the stretching ratios are the same, it is preferred that the primary stretching contributes more than the secondary stretching. In a further preferred embodiment, it is considered that stretching is performed only by the primary stretching. Then, the primary stretching ratio is preferably 8 times or less, more preferably 6 times or less, and particularly preferably 5 times or less. Further, the secondary stretching ratio is preferably 3 times or less and more preferably 1.2 times or less.

Further, in the present invention, the relaxation ratio (times) refers to the ratio at which the fibers shrink in the above heat treatment step. Specifically, the relaxation ratio refers to the ratio at which the length of fibers is shrunk in the heat treatment step in the fiber production step (spinning step), for example, in the heat treatment step performed after the treatment steps including the coagulation step (extrusion of a spinning solution), the water-washing step (including the case where stretching is performed during washing with water), the drying step, the stretching step, and the like. For example, in the case of the heat treatment in which the length of fibers becomes constant, the relaxation ratio becomes 1.0 time, and in the case of the heat treatment in which the length of fibers becomes 50%, the relaxation ratio becomes 0.5 times. The relaxation ratio is not particularly limited; however, the relation ratio is preferably 0.3 to 1.0 times, considering the setting of the shrinkage variation to be 45% or less when a temperature is raised from 50° C. to 300° C. under a load of 0.0054 mN/dtex. Then, the lower limit value of the relaxation ratio is more preferably 0.4 times and particularly preferably 0.5 times, and the upper limit value is more preferably 0.9 times and particularly preferably 0.85 times.

The heat treatment of the present invention includes relaxation heat treatment and stretched heat treatment. For example, assuming that heat treatment is performed when lines of thread (bundle of fibers) move between two rollers, the relaxation heat treatment in the present invention refers to the heat treatment in the state of lines of thread when fibers move between two rollers having the same rotation speed under a condition of temperature in which the fibers do not shrink (constant length state) or in the state in which the moving lines of thread are loose compared with the constant length state (relaxation state). Even in the case where the fibers shrink between two rollers due to the heat treatment, if the tension applied to the fibers has the same level as that in the above state, the relaxation heat treatment is performed. Further, in the present invention, the stretched heat treatment refers to the heat treatment in the state other than that of lines of thread in the above relaxation heat treatment, for example, in the state where a tension applied to the fibers is larger (stretched state) than that in the state of lines of thread when fibers move between two rollers having the same rotation speed under a condition of temperature in which the fibers do not shrink (constant length state). Even in the case where the fibers shrink between two rollers due to the heat treatment, if the tension applied to the fibers is at the same level as that of the above state, the stretched heat treatment is performed. Then, even in the case where the rollers are not used, if the heat treatment is performed in the tension state equal to that of the lines of thread in the relaxation heat treatment, the relaxation heat treatment is performed, and if the heat treatment is performed in the tension state equal to that of the lines of thread in the stretched heat treatment, the stretched heat treatment is performed.

As a method for heat treating the flame retardant synthetic fiber of the present invention, any of a dry-heating method and a wet-heating method that are general heat treatment methods can be used. The wet-heating in the present invention is defined as the treatment in a heated state in an atmosphere (wet air) containing water vapor. As the atmosphere, the relative humidity is 30% or more, preferably 50% or more, more preferably 70% or more, and particularly preferably 100% (saturated water vapor condition). As the relative humidity is higher, a shrinkage variation, fiber whiteness, and the like become satisfactory. Further, examples of the wet-heating method include but are not limited to a water vapor heat treatment method and a wet-heat pressure steam treatment method. Further, in the case of the wet-heat pressure steam treatment method, there is no particular limit to the form of wet-heating, and examples thereof include a method for injecting steam to a device in which lines of thread are placed, a method for injecting steam to a device in which lines of thread are placed to set a saturated water vapor condition, and a method for injecting hot air to a device in which lines of thread are placed with a separately provided hot air producer (heater) and injecting steam. The tension state of the fibers (lines of thread) at a time of heat treatment may be any of relaxation and stretching. Herein, the relaxation state includes a constant length state. Examples of a combination thereof include a dry-heat stretched heat treatment method, a dry-heat relaxation heat treatment method, a heating water vapor stretched heat treatment method, a heating water vapor relaxation heat treatment method, a wet-heat pressure steam stretched heat treatment method, and wet-heat pressure stream relaxation heat treatment method. The dry-heat relaxation heat treatment method, the heating water vapor relaxation heat treatment method, and the wet-heat pressure steam relaxation heat treatment method are preferred, and the dry-heat relaxation heat treatment method and the wet-heat pressure steam relaxation heat treatment method are more preferred. Further, a heat treatment step may be formed by combining a plurality of these methods, and different tension states of fibers (lines of thread).

Generally, in the heat treatment of the flame retardant synthetic fiber, as a treatment temperature is higher, a spinning residual shrinkage stress can be reduced more. Particularly, in the case where fibers are subjected to wet-heat treatment and further, treated in a wet-heat pressure steam, the heat required for the heat treatment is transmitted to the inside of the fibers even at a temperature equal to or lower than the softening temperature or decomposition temperature of the flame retardant synthetic fibers. Therefore, sufficient heat treatment can be performed without coloring and the decrease in strength. The above heat treatment that can be performed is a continuous type or a batch type. Particularly, in the case of using a copolymer containing acrylonitrile in an amount of more than 50 parts by mass, the heating water vapor treatment method and the wet-heat pressure steam treatment method are preferred. In the case of using a copolymer containing acrylonitrile in an amount of 50 parts by mass or less, the dry-heat treatment method and the wet-heat pressure steam treatment method are preferred. This is because the fibers are colored less in any of the methods. In the case of the relaxation heat treatment, the heat treatment temperature is 120° C. to 200° C., preferably 140° C. to 180° C., and more preferably 150° C. to 170° C. in the dry-heat treatment method; 80° C. to 160° C., preferably 90° C. to 150° C., and more preferably 100° C. to 140° C. in the wet-heat pressure steam treatment method;

and 140° C. to 230° C., preferably 150° C. to 210° C., and more preferably 160° C. to 190° C. in the heating water vapor treatment method. In the case of the stretched heat treatment, the heat treatment temperature is 180° C. to 260° C. and preferably 180° C. to 240° C. in the dry-heat treatment method; 150° C. to 230° C. and preferably 160° C. to 210° C. in the wet-heat pressure stream treatment method; and 160° C. to 250° C. and preferably 170° C. to 220° C. in the heating water vapor treatment method. The upper limit of the heat treatment temperature is not particularly limited; however, the upper limit is 300° C., preferably 250° C., and more preferably 220° C. in terms of the coloring of the flame retardant synthetic fiber and from the industrial point of view.

In the present invention, as the heat treatment, it is preferred to perform the relaxation heat treatment, or the dry-heat stretched heat treatment at 180° C. or higher or the wet-heat stretched heat treatment at 150° C. or higher. Aflame retardant synthetic fiber is obtained easily, in which the shrinkage variation is 45% or less when a temperature is raised from 50° C. to 300° C. under a load of 0.0054 mN/dtex. Further, as the heat treatment, it is more preferred that the relaxation heat treatment is performed, and it is particularly preferred that the relaxation heat treatment is performed in wet-heating at 90° C. to 150° C. The heat treatment in the present invention refers to the treatment of shrinkage fibers under heating and reducing and removing a spinning shrinkage stress.

The flame retardant synthetic fiber of the present invention can be used alone and combined with a natural fiber, a regenerated fiber, and other synthetic fibers.

The flame retardant fiber composite of the present invention refers to batting for stuffing, nonwoven fabric, woven fabric, knit fabric, lacework, braiding, and the like that contain the flame retardant synthetic fiber of the present invention.

The flame retardant fiber mixture of the present invention is an example of the flame retardant fiber composite of the present invention, referring to a mixture formed by combining the flame retardant synthetic fiber of the present invention with other fibers. In the present invention, the flame retardant fiber mixture contains 10% by mass or more of the flame retardant synthetic fiber and 90% by mass of at least one kind of a fiber selected from a natural fiber, a regenerated fiber, and a synthetic fiber other than the flame retardant synthetic fiber. Further, the upper limit of the content of the flame retardant synthetic fiber in the flame retardant fiber mixture is preferably 90% by mass or less, and the lower limit of the content of at least one kind of a fiber selected from a natural fiber, a regenerated fiber, and a synthetic fiber other than the flame retardant synthetic fiber is preferably 10% by mass or more.

Examples of the natural fiber include a cotton fiber, a kapok fiber, a flax fiber, a hemp, a ramie fiber, a jute fiber, a Manila fiber, a kenaf fiber, a wool fiber, a mohair fiber, a cashmere fiber, a camel fiber, an alpaca fiber, an Angola fiber, and a silk fiber. Examples of the regenerated fiber include a regenerated cellulose fiber rayon, polynosic, "Cupra" (trade name) manufactured by Asahi Chemical Industry Co., Ltd., "Tincel" (trade name) manufactured by Lenzing AG, "Lenzing Modal" (trade name) manufactured by Lenzing AG), a regenerated collagen fiber, a regenerated protein fiber, a cellulose acetate fiber, and a promix fiber. Examples of the synthetic fiber include a polyester fiber, a polyamide fiber, a polylactic fiber, an acrylic fiber, a polyolefin fiber, a polyvinyl alcohol fiber, a polyvinyl chloride fiber, a polyvinylidene chloride fiber ("Saran" (trade name) manufactured by Asahi Chemical Industry Co., Ltd.), a polychlal fiber, a polyethylene fiber ("Dyneema" (trade name) manufactured by Toyobo Co., Ltd.), a polyurethane fiber, a polyoxymethylene fiber, a polytetrafluoroethylene fiber, an aramid fiber ("Kevlar" (trade name) manufactured by DuPont, "Nomex" (trade name) manufactured by DuPont, "Technora" (trade name) manufactured by Teijin Ltd., "Twaron" (trade name) manufactured by Teijin Ltd., "Conex" (trade name) manufactured by Teijin Ltd.), a benzoate fiber, a polyphenylene sulfide fiber ("Procon" (trade name) manufactured by Toyobo Co., Ltd.), a polyether ether ketone fiber, a Polybenzazole fiber, a polyimide fiber ("P84" (trade name) manufactured by Toyobo Co., Ltd.), and a polyamideimide fiber ("Kolmel" (trade name) manufactured by Kolmel). Further, as the synthetic fiber, flame retardant polyester ("Heim" (trade name) manufactured by Toyobo Co., Ltd., "Trevira CS" (trade name) manufactured by Trevira GmbH), a polyethylene naphthalate fiber ("Teonex" (trade name) manufactured by Teijin Ltd.), a melamine fiber ("Basofil" (trade name) manufactured by Basofil Fiber LLC), an acrylate fiber ("Moiscare" (trade name) manufactured by Toyobo Co., Ltd.), a polybenzoxide fiber ("Zylon" (trade name) manufactured by Toyobo Co., Ltd.), or the like may be used. Further examples of the regenerated fiber include a special regenerated cellulose fiber (rayon fiber containing water glass: 'Visil' (trade name) manufactured by Sateri Co., "FR Corona" (trade name) manufactured by Daiwabo Co., Ltd.), a post-processed flame retardant cellulose fiber coated with a flame retardant, and an untreated flame retardant rayon fiber ("Lenzing FR" (trade name) manufactured by Lenzing AG). The other examples include an acryl oxide fiber, a carbon fiber, a glass fiber, and an activated carbon fiber.

Of those, the cotton fiber, the rayon fiber, the rayon fiber containing water glass, the polyester fiber, the aramid fiber, and the melamine fiber are preferred. The polyester fiber is particularly preferred, which is inexpensive and has bulkiness particularly in the case of nonwoven fabric. Further, the cotton fiber, the rayon fiber, the rayon fiber containing water glass, the aramid fiber, and the melamine fiber are preferred in terms of the ability to further provide flame retardance. The synthetic fiber other than the flame retardant synthetic fiber is a polyester fiber, and the content of a flame retardant mixture is preferably 20% by mass or more, more preferably 30% by mass or more, and particularly preferably 40% by mass or more. Further, the upper limit value is preferably 90% by mass or less.

In the present invention, examples of the flame retardant fiber mixture include composite yarn such as mixed cotton yarn, mixed-spun yarn, commingled yarn, doubled yarns, multiple wound yarn and core-sheath, mixed weave, inter knit, and pile. Examples of the specific form include batting for stuffing, nonwoven fabric, woven fabric, knit fabric, lacework, and braiding.

Examples of the batting for stuffing include opened cotton, raw cotton with seeds in, web, and molded cotton.

Examples of the nonwoven fabric include wet sheet making nonwoven fabric card nonwoven fabric, airlay nonwoven fabric, thermally bonded nonwoven fabric, chemically bonded nonwoven fabric, needle-punched nonwoven fabric, nonwoven fabric interlaced by water flow, and stitch-bonded nonwoven fabric. The thermally bonded nonwoven fabric and the needle-punched nonwoven fabric are inexpensive industrially. Further, the nonwoven fabric may have any of a uniform structure in thickness, width, and length directions, a defined laminated structure, and an undefined laminated structure.

Examples of the woven fabric include plain weave, twill weave, satin weave, variegated plain weave, variegated twill weave, variegated satin weave, fancy weave, brocade, single texture, double texture, multiple texture, warp pile weave, weft pile weave, and interweave. The plain weave, the twill weave, and the satin weave are excellent in texture and strength as goods.

Examples of the knit fabric include circular knitted fabric, weft knitted fabric, warp knitted fabric, pile fabric, plain stitch, plain knit, rib-knit, smooth knit (double knit), rib stitch, purl stitch, Denbigh stitch, cord texture, atlas texture, chain texture, and insertion texture. The plain nit and the rib-knit are excellent in texture as goods.

The textile product (application) of the present invention contains the flame retardant fiber composite, and collectively refers to the following exemplified products. The examples of the textile product include the following.

(1) Clothes and Daily Commodities

Clothes (including a jacket, underwear, a sweater, a best, trousers, etc.), gloves, socks, a muffler, a cap, bedclothes, a pillow, a cushion, a stuffed toy, etc.

(2) Special Clothes

Protective clothing, a fireman uniform, working clothes, winter clothes, etc.

(3) Interior Materials

An upholster, a curtain, wallpaper, a carpet, etc.

(4) Industrial Materials

A filter, a flame-resistant stuffing, a lining material, etc.

For example, when a flame retardant upholstered product such as bedding or furniture (e.g., a bed mattress, a pillow, a comforter, a bedspread, a mattress pad, a futon, a cushion, a chair, etc.) is produced using the fiber product of the present invention, an upholstered product having excellent characteristics such as texture, touch, color, and hygroscopicity can be obtained while keeping flame retardance. Examples of the bed mattress include a pocket coil mattress in which a metallic coil is used, a box coil mattress, or a mattress in which an insulator obtained by foaming styrene, urethane resin, or the like or low-resilience urethane is used. The spread of fire to a structure inside the mattress can be reduced due to the flame retardance of the flame retardant synthetic fiber of the present invention. Therefore, even in mattresses with any structure, a mattress excellent in texture and touch, as well as flame retardance can be obtained. Examples of the chair include a stool, a bench, a side chair, an arm chair, a lounge chair, a sofa, a seat unit (a sectional chair, a separate chair), a rocking chair, a folding chair, a stacking chair, and a swivel chair that are used indoors, and an automobile seat, a seat for shipping, an airplane seat, a train seat, and the like that are used outdoors in seats for vehicles, etc. In these chairs and seats, a flame retardant product having the function of reducing the spread of fire inside, as well as keeping an outer appearance and touch required for ordinary furniture can be obtained.

A textile containing the flame retardant synthetic fiber and/or the flame retardant fiber mixture of the present invention (hereinafter, referred to as a textile of the present invention) may be used with respect to a flame retardant upholstered product as a form of woven fabric or knit fabric for cloth on the surface, or may be used in a form of woven fabric, knit fabric, or nonwoven fabric between the cloth on the surface and the internal structure (e.g., urethane foam or batting). In the case of using the textile of the present invention for the cloth on the surface, the textile of the present invention may be used in place of the conventional cloth on the surface. Further, in the case where the woven fabric or knit fabric of the present invention is sandwiched between the surface cloth and the internal structure, the two pieces of surface cloth may be overlapped to sandwich the woven fabric or knit fabric of the present invention or the internal structure may be covered with the textile of the present invention. In the case where the textile of the present invention is sandwiched between the surface cloth and the internal structure, the outside of the internal structure is covered with the textile of the present invention with respect to at least a portion of the internal structure that is in contact with the surface cloth, and the surface cloth is attached from above the textile of the present invention placed on the outside of the internal structure.

EXAMPLE

Hereinafter, the present invention will be described in more detail by way of examples; however, the present invention is not limited thereto. In the following examples, "%" refers to "% by mass".

(Method for Evaluating the Acceleration of a Dehalogenation Reaction)

The method for evaluating the acceleration of a dehalogenation reaction was performed using a thermogravimetry and differential thermal analysis device ("TG/DTA220" (trade name) manufactured by Seiko Instruments & Electronics Ltd.) as follows.

First, 5 mg of the polymer (1) containing 51.5 parts by mass of acrylonitrile, 47.4 parts by mass of a halogen-containing vinylidene monomer, and 1.1 parts by mass of sodium styrenesulfonate was heated under an air condition (gas flow rate: 200 ml/min., temperature rise speed: 20° C./min.), and the temperature at which the reduction in weight started was measured. In the present invention, the temperature at which the reduction in weight starts is defined as a dehalogenation start temperature. The dehalogenation start temperature was measured to be 243° C.

Then, 10 parts by mass of a metal compound shown in Table 1 was added to 100 parts by mass of the above polymer (1), and 5 mg of the thoroughly mixed sample was heated under an air condition (gas flow rate: 200 ml/min., temperature rise speed: 20° C./min.). When the dehalogenation start temperature was lower than 243° C., it was determined that the dehalogenation reaction was accelerated, which was evaluated as A. Further, when the dehalogenation start temperature was equal to or higher than 243° C., it was determined that the dehalogenation reaction was not accelerated, which was evaluated as B. Table 1 shows the evaluation results of the respective metal compounds.

(Method for Evaluating the Acceleration of a Carbonization Reaction)

The method for evaluating the acceleration of a carbonization reaction was performed using a thermogravimetry and differential thermal analysis device ("TG/DTA220" (trade name) manufactured by Seiko Instruments & Electronics Ltd.) as follows.

First, 5 mg of the polymer (1) containing 51.5 parts by mass of acrylonitrile, 47.4 parts by mass of a halogen-containing vinylidene monomer, and 1.1 parts by mass of sodium styrenesulfonate was heated under an air condition (gas flow rate: 200 ml/min., temperature rise speed: 20° C./min.), and a remaining weight ratio at 500° C. was measured. As a result, the remaining weight ratio was 52%.

Then, 10 parts by mass of a metal compound shown in Table 1 was added to 100 parts by mass of the above polymer (1), and 5 mg of the thoroughly mixed sample was heated under an air condition (gas flow rate: 200 ml/min., temperature rise speed: 20° C./min.). When the remaining weight ratio at 500° C. was 47% or more, it was determined that the carbonization reaction was accelerated, which was evaluated as A. Further, when the remaining weight ratio at 500° C. was less than 47%, it was determined that the carbonization reaction was not accelerated, which was evaluated as B. Table 1 shows the evaluation results of the respective metal compounds.

TABLE 1

| Metal compound | Dechlorination start temperature (° C.) (Method for evaluating dehalogenation reaction acceleration) | 500° C. remaining weight (%) (Method for evaluating carbonization reaction acceleration) | Dechlorination reaction acceleration performance | Carbonization acceleration performance |
|---|---|---|---|---|
| None | 243 | 52 | — | — |
| Zinc oxide | 181 | 62 | A | A |
| Zinc carbonate | 187 | 57 | A | A |
| Zinc sulfide | 238 | 56 | A | A |
| Tungsten oxide | 241 | 54 | A | A |
| Zirconium oxide | 238 | 54 | A | A |
| Tin oxide | 200 | 56 | A | A |
| Copper oxide | 222 | 62 | A | A |
| Copper phosphate | 235 | 53 | A | A |
| Indium trioxide | 236 | 56 | A | A |
| Barium titanate | 242 | 56 | A | A |
| Zinc borate | 237 | 49 | A | A |
| Zinc stannate | 196 | 47 | A | A |
| Metastannic acid | 234 | 51 | A | A |
| Antimony trioxide | 220 | 42 | A | B |
| Antimony pentoxide | 220 | 42 | A | B |
| Sodium antimonate | 220 | 42 | A | B |
| Iron oxide | 233 | 11 | A | B |
| Iron phosphate | 230 | 35 | A | B |
| Ion oxalate | 227 | 28 | A | B |
| Iron sulfide | 226 | 40 | A | B |
| Molybdenum oxide | 241 | 46 | A | B |
| Bismuth trioxide | 197 | 43 | A | B |
| Bismuth oxychloride | 191 | 39 | A | B |
| Copper iodide | 203 | 41 | A | B |
| Aluminum hydroxide | 244 | 45 | B | B |
| Zinc para-toluenesulfonate | 230 | 53 | A | A |

Production Examples 1-9 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., further subjected to relaxation treatment in an unstretched state at 123° C. for 15 minutes in wet-heat pressure steam (saturated water vapor), and further cut to obtain halogen-containing fibers. The fibers thus obtained were short fibers having a fineness of 7.8 dtex and a cut length of 64 mm.

Production Examples 10, 11 of a Halogen-Containing Fiber

A copolymer containing 43% acrylonitrile, 56% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., further subjected to dry-heat relaxation treatment in an unstretched state at 170° C. for 2 minutes, and further cut to obtain halogen-containing fibers. The fibers thus obtained were short fibers having a fineness of 7.8 dtex and a cut length of 64 mm.

Production Example 12 of a Halogen-Containing Fiber

A copolymer containing 38% acrylonitrile, 61% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., further subjected to dry-heat relaxation treatment in an unstretched state at 170° C. for 2 minutes, and further cut to obtain halogen-containing fibers. The fibers thus obtained were short fibers having a fineness of 7.8 dtex and a cut length of 64 mm.

Production Example 13 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1) and antimony trioxide as a metal compound (2-2) were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., further subjected to dry-heat stretched heat treatment at 185° C. for 2 minutes, and further cut to obtain halogen-containing fibers. The fibers thus obtained were short fibers having a fineness of 7.8 dtex and a cut length of 64 mm.

Production Example 14 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., further subjected to wet-heat stretched heat treatment at 150° C. for 15 minutes in wet-heat pressure stream (saturated water vapor), and further cut to obtain halogen-containing fibers. The fibers thus obtained were short fibers having a fineness of 7.8 dtex and a cut length of 64 mm.

Production Example 15 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through nozzles each having 1000 holes and respectively having diameters of 0.10 mm and 0.12 mm, washed with water while being subjected to primary stretching, dried at 120° C., thereafter subjected to secondary stretching at 120° C., further subjected to relaxation treatment in an unstretched state at 123° C. for 10 minutes in wet-heat pressure stream (saturated water vapor), and further cut to obtain halogen-containing fibers. The fibers thus obtained were short fibers respectively having a fineness of 7.8 dtex and a cut length of 64 nm.

Production Example 16 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and cresol novolac epoxy ("EOCN-104S" (trade name) manufactured by Nippon Kayaku Co., Ltd.) as an epoxy-containing compound were added the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., thereafter subjected to relaxation treatment in an unstretched state at 123° C. for 15 minutes in wet-heat pressure stream (saturated water vapor), and further cut to obtain halogen-containing fibers. The fibers thus obtained were short fibers having a fineness of 7.8 dtex and a cut length of 64 mm.

Production Example 17 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony pentoxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., thereafter subjected to relaxation treatment in an unstretched state at 123° C. for 15 minutes in wet-heat pressure stream (saturated water vapor), and further cut to obtain halogen-containing fibers. The fibers thus obtained were short fibers having a fineness of 7.8 dtex and a cut length of 64 mm.

Production Example 18 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1) and copper iodide as a metal compound (2-2) were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., thereafter subjected to secondary stretching at 120° C., further subjected to relaxation treatment in an unstretched state at 123° C. for 15 minutes in wet-heat pressure stream (saturated water vapor), and further cut to obtain halogen-containing fibers. The fibers thus obtained were short fibers having a fineness of 7.8 dtex and a cut length of 64 mm.

Production Example 19 of a Halogen-Containing Fiber

A copolymer containing 51% acrylonitrile, 48% vinylidene chloride, and 1% p-sodium styrenesulfonate was dissolved in acetone so that a resin concentration became 30%. Tin oxide as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., further subjected to relaxation treatment in an unstretched state at 123° C. for 15 minutes in wet-heat pressure stream (saturated water vapor), and further cut to obtain halogen-containing fibers. The fibers thus obtained were short fibers having a fineness of 7.8 dtex and a cut length of 64 mm.

Production Example 20 of a Halogen-Containing Fiber

A copolymer containing 51% acrylonitrile, 48% vinylidene chloride, and 1% p-sodium styrenesulfonate was dissolved in acetone so that a resin concentration became 30%. Zinc carbonate as a metal compound (2-1) and antimony trioxide as a metal compound (2-2) were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., further subjected to relaxation treatment in an unstretched state at 123° C. for 15 minutes in wet-heat pressure stream (saturated water vapor), and further cut to obtain halogen-containing fibers. The fibers thus obtained were short fibers having a fineness of 7.8 dtex and a cut length of 64 mm.

Production Examples 21, 27 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through nozzles each having 1000 holes and respectively having diameters of 0.10 mm and 0.12 mm, washed with water while being subjected to primary stretching, dried at 120° C., further subjected to relaxation treatment in an unstretched state at 110° C. for 30 minutes in wet-heat pressure stream (saturated water vapor), and further cut to obtain halogen-containing fibers. The fibers thus obtained were short fibers respectively having finenesses of 7.8 dtex and 11 dtex and a cut length of 64 mm.

Production Examples 22, 28 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through nozzles each having 1000 holes and respectively having diameters of 0.10 mm and 0.12 mm, washed with water while being subjected to primary stretching, dried at 120° C., further subjected to relaxation treatment in an unstretched state at 120° C. for 10 minutes in wet-heat pressure stream (saturated water vapor), and further cut to obtain halogen-containing fibers. The fibers thus obtained were short fibers respectively having finenesses of 7.8 dtex and 11 dtex and a cut length of 64 mm.

Production Examples 23, 29 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through nozzles each having 1000 holes and respectively having diameters of 0.10 mm and 0.12 mm, washed with water while being subjected to primary stretching, dried at 120° C., further subjected to relaxation treatment in an unstretched state at 123° C. for 10 minutes in wet-heat pressure stream (saturated water vapor), and further cut to obtain halogen-containing fibers. The fibers thus obtained were short fibers respectively having finenesses of 7.8 dtex and 11 dtex and a cut length of 64 mm.

Production Examples 24, 30 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through nozzles each having 1000 holes and respectively having diameters of 0.10 mm and 0.12 mm, washed with water while being subjected to primary stretching, dried at 120° C., further subjected to relaxation treatment in an unstretched state at 123° C. for 30 minutes in wet-heat pressure stream (saturated water vapor), and further cut to obtain halogen-containing fibers. The fibers thus obtained were short fibers respectively having finenesses of 7.8 dtex and 11 dtex and a cut length of 64 mm.

Production Examples 25, 31 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through nozzles each having 1000 holes and respectively having diameters of 0.10 mm and 0.12 mm, washed with water while being subjected to primary stretching, dried at 120° C., further subjected to relaxation treatment in an unstretched state at 130° C. for 5 minutes in wet-heat pressure stream (saturated water vapor), and further cut to obtain halogen-containing fibers. The fibers thus obtained were short fibers respectively having finenesses of 7.8 dtex and 11 dtex and a cut length of 64 mm.

Production Examples 26, 32 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through nozzles each having 1000 holes and respectively having diameters of 0.10 mm and 0.12 mm, washed with water while being subjected to primary stretching, dried at 120° C., further subjected to relaxation treatment in an unstretched state at 130° C. for 20 minutes in wet-heat pressure stream (saturated water vapor), and further cut to obtain halogen-containing fibers. The fibers thus obtained were short fibers respectively having finenesses of 7.8 dtex and 11 dtex and a cut length of 64 mm.

Production Example 33 of a Halogen-Containing Fiber

A copolymer containing 57% acrylonitrile, 41% vinylidene chloride, and 2% sodium allylsulfonate was dissolved in dimethylformamide so that a resin concentration became 25%. Zinc oxide (zinc oxide JIS 3 class) as a metal compound (2-1) and antimony pentoxide as a metal compound (2-2) were added to the obtained resin solution in addition amounts shown in the following Table 2 based on 100 parts by mass of the resin of the obtained resin solution to obtain a spinning dope solution. The spinning dope solution was extruded to a 55% dimethylformamide aqueous solution through a nozzle with 1000 holes, each having a diameter of 0.06 mm, washed with water while being subjected to primary stretching, dried at 120° C., further subjected to relaxation treatment in an unstretched state at 130° C. for 15 minutes in wet-heat pressure stream (saturated water vapor), and further cut to obtain halogen-containing fibers. The fibers thus obtained were short fibers having a fineness of 1.7 dtex and a cut length of 64 mm.

Production Examples 34, 35 of a Halogen-Containing Fiber

A copolymer containing 51% acrylonitrile, 48% vinylidene chloride, and 1% p-sodium styrenesulfonate was dissolved in acetone so that a resin concentration became 30%. Antimony trioxide as a metal compound (2-2) and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., further subjected to dry-heat relaxation treatment in an unstretched state at 170° C. for 2 minutes, and further cut to obtain halogen-containing fibers. The fibers thus obtained were short fibers having a fineness of 7.8 dtex and a cut length of 64 mm.

Production Example 36 of a Halogen-Containing Fiber

A copolymer containing 51% acrylonitrile, 48% vinylidene chloride, and 1% p-sodium styrenesulfonate was dissolved in acetone so that a resin concentration became 30%. Zinc oxide (zinc oxide JIS 3 class) as a metal compound (2-1) and antimony trioxide as a metal compound (2-2) were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a diameter of 0.10 mm, washed with water while being subjected to primary stretching, dried at 120° C., further subjected to dry-heat stretched treatment at 170° C. for 2 minutes, and further cut to obtain halogen-containing fibers. The fibers thus obtained were short fibers having a fineness of 7.8 dtex and a cut length of 64 mm.

Production Example 37 of a Halogen-Containing Fiber

A copolymer containing 51% acrylonitrile, 48% vinylidene chloride, and 1% p-sodium styrenesulfonate was dissolved in dimethylformamide so that a resin concentration became 23%. Zinc oxide (zinc oxide JIS 3 class) as a metal compound (2-1), antimony trioxide as a metal compound (2-2), and polyglycidyl methacrylate (weight average molecular weight: 40,000) as an epoxy-containing compound were added to the obtained resin solution in addition amounts shown in the following Table 2 based on 100 parts by mass of the resin of the obtained resin solution to obtain a spinning dope solution. The spinning dope solution was extruded to a 55% dimethylformamide aqueous solution through a nozzle having a hole diameter of 0.06 mm, washed with water while being subjected to primary stretching, dried at 120° C., thereafter subjected to secondary stretching at 130° C., further subjected to wet-heat stretched treatment at 140° C. for 15 minutes in wet-heat pressure steam (saturated water vapor), and further cut to obtain halogen-containing fibers. The fibers thus obtained were short fibers having a fineness of 1.7 dtex and a cut length of 64 mm.

Production Example 38 of a Halogen-Containing Fiber

A copolymer containing 57% acrylonitrile, 41% vinylidene chloride, and 2% sodium allylsulphonate was dissolved in dimethylformamide so that a resin concentration became 25%. Antimony trioxide as a metal compound (2-2) was added to the obtained resin solution in an addition amount shown in the following Table 2 based on 100 parts by mass of the resin of the obtained resin solution to obtain a spinning dope solution. The spinning dope solution was extruded to a 55% dimethylformamide aqueous solution through a nozzle having a hole diameter of 0.06 mm, washed with water while being subjected to primary stretching, dried at 120° C., thereafter subjected to secondary stretching at 130° C., further subjected to wet-heat stretched treatment at 130° C. for 15 minutes in wet-heat pressure steam (saturated water vapor), and further cut to obtain halogen-containing fibers. The fibers thus obtained were short fibers having a fineness of 1.7 dtex and a cut length of 64 mm.

Production Example 39 of a Halogen-Containing Fiber

Two parts of a copolymer containing 60% acrylonitrile, 30% vinyl chloride, and 10% sodium allylsulphonate, and 22 parts of a copolymer containing 42% acrylonitrile, 57% vinyl chloride, and 1% p-sodium styrenesulphonate were dissolved in dimethylformamide so that a resin concentration became 23%. Metastannic acid as a metal compound (2-1) was added to the obtained resin solution in an addition amount shown in the following Table 2 based on 100 parts by mass of the resin of the obtained resin solution to obtain a spinning dope solution. The spinning dope solution was extruded to a 60% dimethylformamide aqueous solution through a nozzle having a hole diameter of 0.06 mm, washed with water while being subjected to primary stretching, dried at 120° C., further subjected to wet-heat stretched treatment at 130° C. for 15 minutes in wet-heat pressure steam (saturated water vapor), and further cut to obtain halogen-containing fibers. The fibers thus obtained were short fibers having a fineness of 2.2 dtex and a cut length of 64 mm.

Production Example 40 of a Halogen-Containing Fiber

A copolymer containing 55% acrylonitrile, 43% vinylidene chloride, and 2% sodium allylsulphonate was dissolved in dimethyl sulfoxide so that a resin concentration became 23.5%. Antimony trioxide as a metal compound (2-2) was added to the obtained resin solution in an addition amount shown in the following Table 2 based on 100 parts by mass of the resin of the obtained resin solution to obtain a spinning dope solution. The spinning dope solution was extruded to a 55% dimethyl sulfoxide aqueous solution through a nozzle having a hole diameter of 0.065 mm, washed with water while being subjected to primary stretching, dried at 120° C., further subjected to wet-heat stretched treatment at 130° C. for 15 minutes in wet-heat pressure steam (saturated water vapor), and further cut to obtain halogen-containing fibers. The fibers thus obtained were short fibers having a fineness of 2.2 dtex and a cut length of 64 mm.

Production Example 41 of a Halogen-Containing Fiber

A copolymer containing 55% acrylonitrile, 43% vinylidene chloride, and 2% sodium allylsulphonate was dissolved in dimethyl sulfoxide so that a resin concentration became 23.5%. Antimony trioxide as a metal compound (2-2) was added to the obtained resin solution in an addition amount shown in the following Table 2 based on 100 parts by mass of the resin of the obtained resin solution to obtain a spinning dope solution. The spinning dope solution was extruded to a 55% dimethyl sulfoxide aqueous solution through a nozzle having a hole diameter of 0.065 mm, washed with water while being subjected to primary stretching, dried at 120° C., further subjected to wet-heat stretched treatment at 130° C. for 15 minutes in wet-heat pressure steam (saturated water vapor), and further cut to obtain halogen-containing fibers. The fibers thus obtained were short fibers having a fineness of 2.2 dtex and a cut length of 64 mm.

Production Example 42 of a Halogen-Containing Fiber

A copolymer containing 55% acrylonitrile, 43% vinylidene chloride, and 2% sodium allylsulphonate was dissolved in dimethyl sulfoxide so that a resin concentration became 23.5%. Zinc oxide (zinc oxide JIS 3 class) as a metal compound (2-1) was added to the resin solution thus obtained in an addition amount shown in the following Table 2 based on 100 parts by mass of the resin of the obtained resin solution to obtain a spinning dope solution. The spinning dope solution was extruded to a 55% dimethyl sulfoxide aqueous solution through a nozzle having a hole diameter of 0.065 mm, washed with water while being subjected to primary stretching, dried at 120° C., further subjected to wet-heat stretched treatment at 130° C. for 2 minutes in wet-heat pressure steam (saturated water vapor), and further cut to obtain halogen-containing fibers. The fibers thus obtained were short fibers having a fineness of 2.2 dtex and a cut length of 64 mm.

Production Example 43 of a Halogen-Containing Fiber

A copolymer containing 51% acrylonitrile, 48% vinylidene chloride, and 1% p-sodium styrenesulfonate was dissolved in acetone so that a resin concentration became 30%. Antimony trioxide as a metal compound (2-2) and aluminum hydroxide as another metal oxide were added to the obtained resin solution in addition amounts shown in the following Table 2 based on 100 parts by mass of the resin of the obtained resin solution to obtain a spinning dope solution. The spinning dope solution was extruded to a 30% acetone aqueous solution through a nozzle with 1000 holes, each having a hole diameter of 0.10 mm, washed with water while being subjected to primary stretching, dried at 120° C., further subjected to relaxation treatment in an unstretched state at 123° C. for 15 minutes in wet-heat pressure steam (saturated water vapor), and further cut to obtain halogen-containing fibers. The fibers thus obtained were short fibers having a fineness of 7.8 dtex and a cut length of 64 mm.

Production Example 44 of a Halogen-Containing Fiber

A copolymer containing 50% acrylonitrile, 49.5% vinyl chloride, and 0.5% sodium styrenesulfonate was dissolved in acetone so that a resin concentration became 30%. Zinc hydroxystannate as a metal compound (2-1) and polyglycidylmethacrylate (weight average molecular weight: 40,000) as an epoxy-containing compound were added to the resin solution thus obtained in addition amounts shown in the following Table 2 based on 100 parts by mass of the resin of the obtained resin solution to obtain a spinning dope solution. Further, 0.5 parts by mass of "TINUVIN 1577 FF" (2-(4,6-diphenyl-1,3,5-triazine-2-yl)) manufactured by Ciba Specialty Chemicals Inc. was added to the spinning dope solution. The spinning dope solution was extruded to a 25% acetone aqueous solution through a nozzle with 120,000 holes, each having a hole diameter of 0.10 mm, washed with water while being subjected to primary stretching, dried at 135° C., thereafter subjected to secondary stretching at 145° C., further subjected to dry-heat stretched treatment at 170° C. for 3 minutes, and further cut to obtain halogen-containing fibers. The fibers thus obtained were short fibers having a fineness of 2.2 dtex and a cut length of 51 mm.

Production Example 45 of a Halogen-Containing Fiber

A copolymer containing 52% acrylonitrile, 46.8% vinylidene chloride, and 1.2% sodium styrenesulfonate was dissolved in acetone so that a resin concentration became 30%. Zinc hydroxystannate as a metal compound (2-1) and antimony trioxide as a metal compound (2-2) were added to the obtained resin solution in addition amounts shown in the following Table 2 based on 100 parts by mass of the resin of the obtained resin solution to obtain a spinning dope solution. The spinning dope solution was extruded to a 38% acetone aqueous solution through a nozzle with 15,000 holes, each having a hole diameter of 0.08 mm, washed with water while being subjected to primary stretching, dried at 120° C., thereafter subjected to secondary stretching at 150° C., further subjected to dry-heat stretched treatment at 170° C. for 30 minutes, and further cut to obtain halogen-containing fibers. The fibers thus obtained were short fibers having a fineness of 3 dtex and a cut length of 38 mm.

Production Example 46 of a Halogen-Containing Fiber

A copolymer containing 52% acrylonitrile, 47% vinylidene chloride, and 1% sodium methallylsulfonate was dissolved in dimethylformamide so that a resin concentration became 25%. Zirconium oxide as a metal compound (2-1) and antimony pentoxide as a metal compound (2-2) were added to the obtained resin solution in addition amounts shown in the following Table 2 based on 100 parts by mass of the resin of the obtained resin solution to obtain a spinning dope solution. The spinning dope solution was extruded to a 50% dimethylformamide aqueous solution through a nozzle with 30,000 holes, each having a hole diameter of 0.07 mm, washed with water while being subjected to primary stretching, dried at 130° C., further subjected to relaxation treatment in an unstretched state at 120° C. for 15 minutes in wet-heat pressure steam (saturated water vapor), and further cut to obtain halogen-containing fibers. The fibers thus obtained were short fibers having a fineness of 7.8 dtex and a cut length of 64 mm.

Production Example 47 of a Halogen-Containing Fiber

A copolymer containing 50% acrylonitrile, 48% vinyl chloride, and 2% sodium methallylsulfonate was dissolved in acetone so that a resin concentration became 30% to obtain a spinning dope solution. The spinning dope solution was extruded to a 30% acetone aqueous solution through a nozzle with 30,000 holes, having a hole diameter of 0.07 mm, washed with water while being subjected to primary stretching, dried at 135° C., thereafter subjected to secondary stretching at 145° C., further subjected to relaxation treatment in an unstretched state at 115° C. for 15 minutes in wet-heat pressure steam (saturated water vapor), dried at 115° C. for 10 minutes after the relaxation treatment, stretched until crimps disappeared, and further cut to obtain halogen-containing fibers. The fibers thus obtained were short fibers having a fineness of 7.8 dtex and a cut length of 64 mm.

Production Example 48 of a Halogen-Containing Fiber

A copolymer containing 57% acrylonitrile, 40% vinylidene chloride, and 1% sodium allylsulfonate was dissolved in dimethylformamide so that a resin concentration became 24.5%. Antimony trioxide as a metal compound (2-2) was added to the obtained resin solution in an addition amount shown in the following Table 2 based on 100 parts by mass of the resin of the obtained resin solution to obtain a spinning dope solution. The spinning dope solution was extruded to a 55% dimethylformamide aqueous solution through a nozzle with 100,000 holes, each having a hole diameter of 0.06 mm, washed with water while being subjected to primary stretching, dried at 130° C., further subjected to wet-heat stretched treatment at 115° C. for 15 minutes in wet-heat pressure steam (saturated water vapor), and further cut to obtain halogen-containing fibers. The fibers thus obtained were short fibers having a fineness of 1.9 dtex and a cut length of 38 mm.

TABLE 2

| | | | Metal compound (2) | | | | | | | |
|---|---|---|---|---|---|---|---|---|---|---|
| | | | Metal compound (2-1) | | Metal compound (2-2) | | Other metal compounds | | Epoxy compound | |
| Experiment No. | Production example | Content of acrylonitrile of polymer (1) (%) | Compound name | Addition amount (part by mass) | Compound name | Addition amount (part by mass) | Compound name | Addition amount (part by mass) | Compound name | Addition amount (part by mass) |
| Example 1 | 1 | 51 | Zinc oxide | 0.1 | | | | | | |
| Example 2 | 2 | 51 | Zinc oxide | 0.1 | Antimony trioxide | 15 | | | | |
| Example 3 | 3 | 51 | Zinc oxide | 2 | | | | | | |
| Example 4 | 4 | 51 | Zinc oxide | 2 | Antimony trioxide | 4 | | | | |
| Example 5 | 5 | 51 | Zinc oxide | 2 | Antimony trioxide | 15 | | | | |
| Example 6 | 6 | 51 | Zinc oxide | 2 | Antimony trioxide | 15 | | | pGMA | 0.6 |
| Example 7 | 7 | 51 | Zinc oxide | 2 | Antimony trioxide | 15 | | | pGMA | 6 |
| Example 8 | 8 | 51 | Zinc oxide | 2 | Antimony trioxide | 15 | | | pGMA | 20 |
| Example 9 | 9 | 51 | Zinc oxide | 10 | Antimony trioxide | 15 | | | | |
| Example 10 | 10 | 43 | Zinc oxide | 2 | Antimony trioxide | 15 | | | | |
| Example 11 | 11 | 43 | Zinc oxide | 1 | Antimony trioxide | 15 | | | pGMA | 6 |
| Example 12 | 12 | 38 | Zinc oxide | 2 | Antimony trioxide | 15 | | | pGMA | 6 |
| Example 13 | 13 | 51 | Zinc oxide | 2 | Antimony trioxide | 15 | | | | |
| Example 14 | 14 | 51 | Zinc oxide | 2 | Antimony trioxide | 10 | | | pGMA | 6 |
| Example 15 | 15 | 51 | Zinc oxide | 2 | Antimony trioxide | 15 | | | pGMA | 0.3 |
| Example 16 | 16 | 51 | Zinc oxide | 2 | Antimony troxide | 15 | | | Cresol novolac epoxy | 6 |
| Example 17 | 17 | 51 | Zinc oxide | 2 | Antimony pentoxide | 15 | | | pGMA | 6 |
| Example 18 | 18 | 51 | Zinc oxide | 2 | Copper iodide | 15 | | | | |
| Example 19 | 19 | 51 | Tin oxide | 2 | Antimony trioxide | 15 | | | pGMA | 6 |
| Example 20 | 20 | 51 | Zinc carbonate | 2 | Antimony trioxide | 15 | | | | |
| Example 21 | 21 | 51 | Zinc oxide | 2 | Antimony trioxide | 15 | | | pGMA | 6 |
| Example 22 | 22 | 51 | Zinc oxide | 2 | Antimony trioxide | 15 | | | pGMA | 0.3 |
| Example 23 | 23 | 51 | Zinc oxide | 2 | Antimony trioxide | 15 | | | pGMA | 0.3 |
| Example 24 | 24 | 51 | Zincoxide | 2 | Antimony trioxide | 15 | | | pGMA | 0.3 |
| Example 25 | 25 | 51 | Zinc oxide | 2 | Antimony trioxide | 15 | | | pGMA | 0.3 |
| Example 26 | 26 | 51 | Zinc oxide | 2 | Antimony trioxide | 15 | | | pGMA | 0.3 |
| Example 27 | 27 | 51 | Zinc oxide | 2 | Antimony trioxide | 15 | | | pGMA | 6 |
| Example 28 | 28 | 51 | Zinc oxide | 2 | Antimony trioxide | 15 | | | pGMA | 0.3 |
| Example 29 | 29 | 51 | Zinc oxide | 2 | Antimony trioxide | 15 | | | pGMA | 0.3 |
| Example 30 | 30 | 51 | Zinc oxide | 2 | Antimony trioxide | 15 | | | pGMA | 0.3 |
| Example 31 | 31 | 51 | Zinc oxide | 2 | Antimony trioxide | 15 | | | pGMA | 0.3 |
| Example 32 | 32 | 51 | Zinc oxide | 2 | Antimony trioxide | 15 | | | pGMA | 0.3 |
| Example 33 | 33 | 57 | Zinc oxide | 2 | Antimony pentoxide | 10 | | | | |
| Comparative Example 1 | 34 | 51 | | | Antimony trioxide | 15 | | | | |
| Comparative Example 2 | 35 | 51 | | | Antimony trioxide | 15 | | | pGMA | 6 |

TABLE 2-continued

| | | | Metal compound (2) | | | | | | | |
|---|---|---|---|---|---|---|---|---|---|---|
| | | | Metal compound (2-1) | | Metal compound (2-2) | | Other metal compounds | | Epoxy compound | |
| Experiment No. | Production example | Content of acrylonitrile of polymer (1) (%) | Compound name | Addition amount (part by mass) | Compound name | Addition amount (part by mass) | Compound name | Addition amount (part by mass) | Compound name | Addition amount (part by mass) |
| Comparative Example 3 | 36 | 51 | Zinc oxide | 10 | Antimony trioxide | 15 | | | | |
| Comparative Example 4 | 37 | 51 | Zinc oxide | 2 | Antimony trioxide | 15 | | | PGMA | 6 |
| Comparative Example 5 | 38 | 57 | | | Antimony trioxide | 2.5 | | | | |
| Comparative Example 6 | 39 | 43.5 | Metastannic acid | 2 | | | | | | |
| Comparative Example 7 | 40 | 55 | | | Antimony trioxide | 2 | | | | |
| Comparative Example 8 | 41 | 55 | | | Antimony trioxide | 2 | | | | |
| Comparative Example 9 | 42 | 55 | Zinc oxide | 2 | | | | | | |
| Comparative Example 10 | 43 | 51 | | | Antimony trioxide | 15 | Aluminum hydroxide | 2 | | |
| Comparative Example 11 | 44 | 50 | Zinc hydroxystannate | 15 | | | | | pGMA | 5 |
| Comparative Example 12 | 45 | 52 | Zinc hydroxystannate | 12 | Antimony trioxide | 10 | | | | |
| Comparative Example 13 | 46 | 52 | Zirconium oxide | 0.05 | Antimony pentoxide | 1 | | | | |
| Comparative Example 14 | 47 | 50 | | | | | | | | |
| Comparative Example 15 | 48 | 57 | | | Antimony trioxide | 2.5 | | | | |

Table 3 shows spinning conditions such as a primary stretching ratio (times), a secondary stretching ratio (times), a relaxation ratio (times) at a time of heat treatment, and a total stretching ratio (times) in Production Examples 1-48. The total stretching ratio (times) is a value obtained by multiplying a primary stretching ratio (times) by a secondary stretching ratio (times) and by a relaxation ratio (times) at a time of heat treatment.

TABLE 3

| | | Spinning condition | | | | | | |
|---|---|---|---|---|---|---|---|---|
| | | | | | | Heat treatment | | |
| Experiment No. | Production example | Primary stretching ratio (times) | Secondary stretching ratio (times) | Heat treatment relaxation ratio (times) | Total stretching ratio (times) | Heat treatment method | Temperature (° C.) | Time (min) |
| Example 1 | 1 | 3.75 | 1.00 | 0.70 | 2.63 | Wet-heat relaxation | 123 | 15 |
| Example 2 | 2 | 3.75 | 1.00 | 0.70 | 2.63 | Wet-heat relaxation | 123 | 15 |
| Example 3 | 3 | 3.75 | 1.00 | 0.70 | 2.63 | Wet-heat relaxation | 123 | 15 |
| Example 4 | 4 | 3.75 | 1.00 | 0.70 | 2.63 | Wet-heat relaxation | 123 | 15 |
| Example 5 | 5 | 3.75 | 1.00 | 0.70 | 2.63 | Wet-heat relaxation | 123 | 15 |
| Example 6 | 6 | 3.75 | 1.00 | 0.70 | 2.63 | Wet-heat relaxation | 123 | 15 |
| Example 7 | 7 | 3.75 | 1.00 | 0.70 | 2.63 | Wet-heat relaxation | 123 | 15 |
| Example 8 | 8 | 3.75 | 1.00 | 0.70 | 2.63 | Wet-heat relaxation | 123 | 15 |
| Example 9 | 9 | 3.75 | 1.00 | 0.70 | 2.63 | Wet-heat relaxation | 123 | 15 |
| Example 10 | 10 | 3.75 | 1.00 | 0.80 | 3.00 | Dry-heat relaxation | 170 | 2 |
| Example 11 | 11 | 3.75 | 1.00 | 0.80 | 3.00 | Dry-heat relaxation | 170 | 2 |
| Example 12 | 12 | 3.75 | 1.00 | 0.80 | 3.00 | Dry-heat relaxation | 170 | 2 |

TABLE 3-continued

| | | Spinning condition | | | | | | |
|---|---|---|---|---|---|---|---|---|
| | | | | Heat | | Heat treatment | | |
| Experiment No. | Production example | Primary stretching ratio (times) | Secondary stretching ratio (times) | treatment relaxation ratio (times) | Total stretching ratio (times) | Heat treatment method | Temperature (° C.) | Time (min) |
| Example 13 | 13 | 3.75 | 1.00 | 0.80 | 3.00 | Dry-heat stretching | 185 | 2 |
| Example 14 | 14 | 5.25 | 1.00 | 0.85 | 4.46 | Wet-heat stretching | 150 | 15 |
| Example 15 | 15 | 3.75 | 1.20 | 0.77 | 3.47 | Wet-heat relaxation | 123 | 10 |
| Example 16 | 16 | 3.75 | 1.00 | 0.70 | 2.63 | Wet-heat relaxation | 123 | 15 |
| Example 17 | 17 | 3.75 | 1.00 | 0.70 | 2.63 | Wet-heat relaxation | 123 | 15 |
| Example 18 | 18 | 3.75 | 1.00 | 0.70 | 2.63 | Wet-heat relaxation | 123 | 15 |
| Example 19 | 19 | 3.75 | 1.00 | 0.70 | 2.63 | Wet-heat relaxation | 123 | 15 |
| Example 20 | 20 | 3.75 | 1.00 | 0.70 | 2.63 | Wet-heat relaxation | 123 | 15 |
| Example 21 | 21 | 3.75 | 1.00 | 0.69 | 2.59 | Wet-heat relaxation | 110 | 30 |
| Example 22 | 22 | 3.75 | 1.00 | 0.83 | 3.11 | Wet-heat relaxation | 120 | 10 |
| Example 23 | 23 | 3.75 | 1.00 | 0.77 | 2.89 | Wet-heat relaxation | 123 | 10 |
| Example 24 | 24 | 3.75 | 1.00 | 0.75 | 2.81 | Wet-heat relaxation | 123 | 30 |
| Example 25 | 25 | 3.75 | 1.00 | 0.69 | 2.59 | Wet-heat relaxation | 130 | 5 |
| Example 26 | 26 | 3.75 | 1.00 | 0.69 | 2.59 | Wet-heat relaxation | 130 | 20 |
| Example 27 | 27 | 3.75 | 1.00 | 0.67 | 2.51 | Wet-heat relaxation | 110 | 30 |
| Example 28 | 28 | 3.75 | 1.00 | 0.85 | 3.19 | Wet-heat relaxation | 120 | 10 |
| Example 29 | 29 | 3.75 | 1.00 | 0.77 | 2.89 | Wet-heat relaxation | 123 | 10 |
| Example 30 | 30 | 3.75 | 1.00 | 0.75 | 2.81 | Wet-heat relaxation | 123 | 30 |
| Example 31 | 31 | 3.75 | 1.00 | 0.69 | 2.59 | Wet-heat relaxation | 130 | 5 |
| Example 32 | 32 | 3.75 | 1.00 | 0.69 | 2.59 | Wet-heat relaxation | 130 | 20 |
| Example 33 | 33 | 5.0 | 1.00 | 0.64 | 3.20 | Wet-heat relaxation | 130 | 15 |
| Comparative Example 1 | 34 | 3.75 | 1.00 | 0.70 | 2.63 | Dry-heat relaxation | 170 | 2 |
| Comparative Example 2 | 35 | 3.75 | 1.00 | 0.70 | 2.63 | Dry-heat relaxation | 170 | 2 |
| Comparative Example 3 | 36 | 5.9 | 1.00 | 0.85 | 5.02 | Dry-heat stretching | 170 | 2 |
| Comparative Example 4 | 37 | 3.3 | 2.00 | 0.70 | 4.62 | Wet-heat stretching | 140 | 15 |
| Comparative Example 5 | 38 | 5.0 | 1.50 | 0.80 | 6.00 | Wet-heat stretching | 130 | 15 |
| Comparative Example 6 | 39 | 6.0 | 1.00 | 0.85 | 5.10 | Wet-heat stretching | 130 | 15 |
| Comparative Example 7 | 40 | 6.0 | 1.00 | 0.80 | 4.80 | Wet-heat stretching | 130 | 15 |
| Comparative Example 8 | 41 | 4.9 | 1.00 | 0.85 | 4.17 | Wet-heat stretching | 130 | 15 |
| Comparative Example 9 | 42 | 5.6 | 1.00 | 0.85 | 4.76 | Wet-heat stretching | 130 | 2 |
| Comparative Example 10 | 43 | 3.75 | 1.00 | 0.70 | 2.63 | Wet-heat relaxation | 123 | 15 |
| Comparative Example 11 | 44 | 2.18 | 2.75 | 0.92 | 5.01 | Dry-heat stretching | 170 | 3 |
| Comparative Example 12 | 45 | 2.21 | 3.00 | 0.80 | 5.29 | Dry-heat stretching | 170 | 0.5 |
| Comparative Example 13 | 46 | 8.0 | 1.00 | 0.80 | 6.40 | Wet-heat relaxation | 120 | 15 |
| Comparative Example 14 | 47 | 3.3 | 2.49 | 0.70 | 5.75 | Wet-heat relaxation | 115 | 15 |

TABLE 3-continued

| | | Spinning condition | | | | | | |
|---|---|---|---|---|---|---|---|---|
| | | | | Heat | | Heat treatment | | |
| Experiment No. | Production example | Primary stretching ratio (times) | Secondary stretching ratio (times) | treatment relaxation ratio (times) | Total stretching ratio (times) | Heat treatment method | Temperature (° C.) | Time (min) |
| Comparative Example 15 | 48 | 5.6 | 1.00 | 0.85 | 4.76 | Wet-heat stretching | 115 | 15 |

(Method for Producing a Test Body for Evaluating FLame Retardance)

The flame retardance of a flame retardant synthetic fiber, a flame retardant fiber composite, and a textile product using the same were evaluated by producing a sample of a test body for evaluating flame retardance by the following method.

1. Method for Producing Thermally Bonded Nonwoven Fabric for a Flame Retardance Evaluation Test The fibers shown below were mixed so as to have a predetermined mixed ratio as shown in Tables 4 and 5. The mixture was opened with a card, and thereafter, thermally bonded nonwoven fabric with a predetermined basis weight was produced by an ordinary heat-fusion method. The halogen-containing fibers produced by the production methods shown in Production Examples 1-48 of halogen-containing fibers, "Tetron" (fineness: 6 dtex, cut length: 51 mm, melting point: 110° C., which also may be referred to as reg.PET in the following) (trade name) manufactured by Toray Industries Inc., which is polyester fibers generally used as polyester-based fibers, "Safmet" (fineness: 4.4 dtex, cut length: 51 mm, which also may be referred to as melt PET in the following) (trade name) manufactured by Toray Industries Inc., which is heat-fusible polyester fibers, general-purpose rayon and/or para-based aramid fibers ("Kevlar" (trade name) manufactured by DuPont), and special regenerated cellulose fibers ("Visil" (trade name) manufactured by Sateri Co.).

2. Method for Producing Needle-Punched Nonwoven Fabric for a Flame Retardance Evaluation Test The halogen-containing fibers produced by the production methods shown in Production Examples 5, 11, and 35, "Tetron" (fineness: 6 dtex, cut length: 51 mm) (trade name) manufactured by Toray Industries Inc., which is polyester fibers generally used as polyester-based fibers, and/or cotton were mixed so that the above fibers had a predetermined mixed ratio shown in Table 5. Then, the mixture was opened with a card, and thereafter, needle-punched nonwoven fabric with a predetermined basis weight was produced by an ordinary needle punch method.

3. Method for Producing a Pillow Top Mattress Test Body

Figure 2:
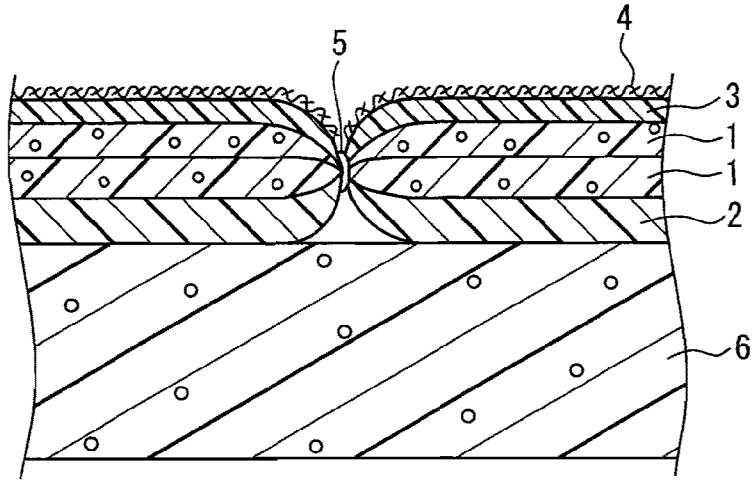
FIG. 2 is a side cross-sectional view showing a configuration of the test body for evaluating flame retardance shown in FIG. 1.

FIGS. 1 and 2 show a configuration of a pillow top mattress. A structure in which 2 sheets of polyurethane foam (1) (Type 360S manufactured by Toyo Tire & Rubber Co., Ltd.) with a size of 30 cm (depth)×45 cm (width)×1.9 cm (thickness) and a density of 22 kg/m$^3$, one sheet of polyurethane foam (2) (Type 360S manufactured by Toyo Tire & Rubber Co., Ltd.) with a size of 30 cm (depth)×45 cm (width)×1.27 cm (thickness) and a density of 22 kg/m$^3$, one sheet of nonwoven fabric (3) produced by the production method of nonwoven fabric for a flame retardance evaluation test, one sheet of a textile (basis weight: 120 g/m$^2$) selected from polyester/polypropylene woven fabric, polyester woven fabric, rayon/polyester woven fabric, and cotton woven fabric as a surface textile (4) of an outer layer were laminated as shown in FIG. 2 was quilted with a nylon yarn (5) at a quilting interval of 20 cm, and the quilted structure was attached to polyurethane foam (6) (Type 360S manufactured by Toyo Tire & Rubber Co., Ltd.) with a thickness of 15 cm, whereby a pillow top mattress test body was produced.

4. A Production Method of a Tight Top Mattress Test Body

Figure 3:
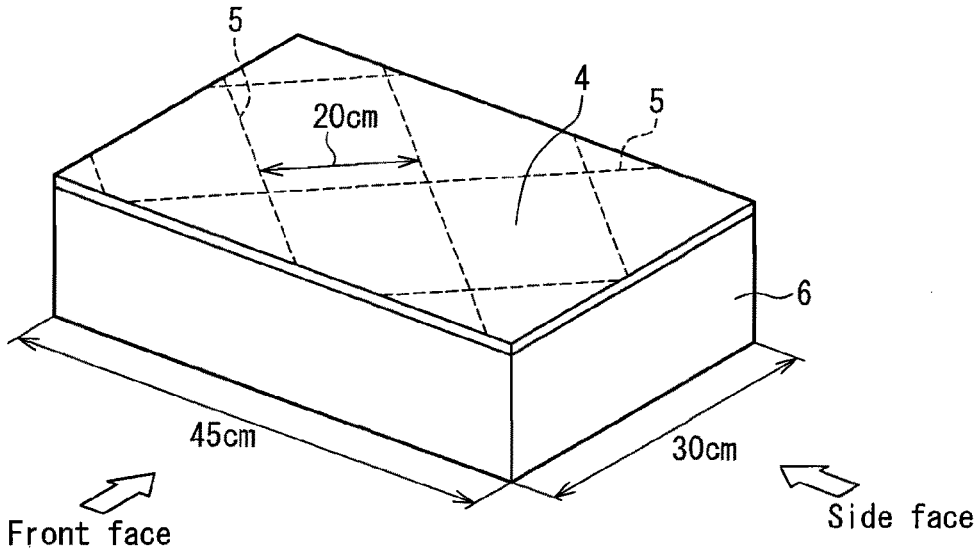
FIG. 3 is a general view showing a configuration of a test body for evaluating flame retardance in another example of the present invention.
Figure 4:
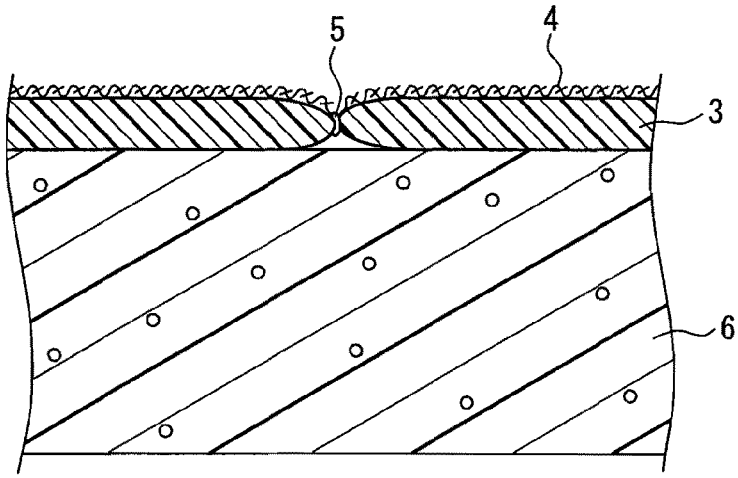
FIG. 4 is a side cross-sectional view showing a configuration of the test body for evaluating flame retardance shown in FIG. 3.

FIGS. 3 and 4 show a configuration of a tight top mattress test body. A structure in which one sheet of the nonwoven fabric (3) produced by the production method of nonwoven fabric for a flame retardance evaluation test and one sheet of a textile (basis weight: 120 g/m$^2$) selected from polyester/polypropylene woven fabric, polyester woven fabric, rayon/polyester woven fabric, and cotton woven fabric as the surface textile (4) of an outer layer were laminated as shown in FIG. 4 was quilted with the nylon yarn (5) at a quilting interval of 20 cm, and the quilted structure was attached to polyurethane foam (6) (Type 360S manufactured by Toyo Tire & Rubber Co., Ltd.) with a thickness of 15 cm, whereby a tight top mattress test body was produced.

5. Method for Producing a Test Body of a Pillow (Production of a Filling Material)

The halogen-containing fibers produced by the production methods shown in Production Examples 5, 11, and 35 and "Tetron" (fineness: 6 dtex, cut length: 51 mm) (trade name) manufactured by Toray Industries Inc., which is polyester fibers generally used as polyester-based fibers were used. These fibers were opened with a card to a web shape at a mixed ratio shown in the following Table 5 and multi-layered to produce a filling material.

(Production of a Cover)

Fifty percent by weight of cotton fibers and 50% by weight of polyester fibers were mixed-spun to obtain No. 34 metric count spun yarn. A plain woven textile with a basis weight of 120 g/m$^2$ was produced using the spun yarn by a well-known method.

(Method for Producing a Cushion for Flame Retardance Evaluation)

The filling material thus produced was cut to a size of about 30.5 cm (depth)×30.5 cm (width). The filing material was inserted in the textile (cover) cut to a size of about 38.1 cm (depth)×38.1 cm (width), and a plate with a weight of 325 g was placed on the textile and adjusted so that the height of a cushion became in a range of 89 mm (3.5 inches) to 102 mm (4.0 inches), and four sides were dosed using cotton yarn, whereby a cushion for evaluating flame retardance was produced.

6. Method for Producing a Test Body of a Textile

The halogen-containing fibers produced by the production methods shown in Production Examples 5, 11, and 35 and cotton were mixed so as to have a predetermined mixed ratio as shown in the following Table 5. The mixture was opened with a card, and thereafter, needle-punched nonwoven fabric with a predetermined basis weight was produced by an ordinary needle punch method. The produced needle-punched nonwoven fabric was compressed thermally with a hot presser machine at 150° C. for 300 seconds to produce a test body with a thickness of 2 mm. The test body was used as the textile.

7. Method for Producing a Test Body of a Knit Textile

The halogen-containing fibers produced in production examples and cotton fibers were mixed in predetermined amounts to produce mixed-spun yarn (No. 34 metric count), and a knit textile having a predetermined mixed ratio was produced using a well-known circular knitting machine.

(Flame Retardance Evaluation Method)

The flame retardance of the flame retardant synthetic fibers in the examples was evaluated using a test body produced in the procedure of the production of a test body for evaluating flame retardance.

1. Panel Test Evaluation Method

The panel test evaluation method was performed in accordance with a method for a burning test of a bed upper surface of 16 CFR 1633, the U.S. bed burning test method. The method for a burning test of a bed upper surface of U.S. 16 CFR 1633 can be briefly described as follows: a T-shaped burner is set horizontally in a place 39 mm above the upper surface of a bed, using propane gas as combustion gas, and the upper surface is inflamed for 70 seconds at a gas pressure of 101 KPa and a gas flow rate of 12.9 L/min. Flame retardance was evaluated as follows.

A rank pass: when a test was conducted by the above test method, self-extinguishment was achieved, and cracks or holes were not formed in a portion exposed to flame.

B rank pass: when a test was conducted by the above test method, self-extinguishment was achieved; however, cracks of less than 1 cm were formed in a portion exposed to flame.

C rank pass: when a test was conducted by the above test method, self-extinguishment was achieved; however, cracks of equal to or more than 1 cm were formed in a portion exposed to flame.

D rank pass: when a test was conducted by the above test method, inside inflammable urethane was ignited once and the fire was extinguished immediately; finally, self-extinguishment was achieved.

Fail: when a test was conducted by the above test method, inside inflammable urethane was ignited, and the fire was extinguished forcefully to stop the test.

2. Stove Test Evaluation Method

A pearlite plate with a size of 200 mm (depth)×200 mm (width)×10 mm (thickness), having a hole with a diameter of 15 cm at the center thereof, was prepared. Nonwoven fabric produced by a method for producing thermally bonded nonwoven fabric for a flame retardance evaluation test was placed on the pearlite plate, and four sides were fixed with clips so that the nonwoven fabric for a flame retardance evaluation test did not shrink during heating. This sample was set at a gas stove ("PA-10H-2" (trade name) manufactured by Paloma Ltd.) so as to be away from the surface of a burner by 40 mm in such a manner that the center of the sample was matched with the center of the burner, with the surface of the nonwoven fabric for a flame retardance evaluation test faced upward. Propane with a purity of 99% or more was used as combustion gas, the height of flame was set to be 25 mm, and the flame contact time was set to be 180 seconds. At this time, the case where there were no holes and cracks passing through a carbonized layer of the nonwoven fabric for a flame retardance evaluation test or the case where there were cracks passing through the carbonized layer although there were no holes passing therethrough was determined to pass the test, and the case where both holes and cracks were found was determined to fail the text.

3. TB604 Test Evaluation Method

Flame retardance was evaluated based on the burning test method in Draft (TB 604) Section 2 of Technical Bulletin 604, issued in October 2004, in Calif. U.S.A The TB 604 burning test method in Calif. U.S.A. can be described briefly as follows: in the case of a test targeting pillows and cushions, a portion ¾ inches below one corner of the cushion for flame retardance evaluation placed horizontally was inflamed with flame of 35 mm height) for 20 seconds. If the weight reduction ratio is 25% by weight or less after 6 minutes, the result is determined to pass the test. In Table 5, the case where the weight reduction ratio is within 25% by weight is determined to pass the test, and the case where the weight reduction ratio exceeds 25% by weight is determined to fail the test. A burner tube to be used has an inner diameter of 6.5 mm, an outer size of 8 mm, and a length of 200 mm. Butane gas with a purity of 99% or more is used as combustion gas, the flow rate of butane gas is 45 ml/min., and the height of flame is about 35 mm.

4. JIS L1091 A-4 Test Evaluation Method

The evaluation of a textile was made based on a JIS L1091 A-4 method. Five sheets of each test body (8.9 cm (depth)× 25.4 cm (width)) produced by the test body production methods assuming a textile were prepared and respectively set at a support frame. Then, the test body was held vertically at a vertical burning test machine pursuant to the JIS L1091 A-4 test, and the positions of a Bunsen burner attached at an angle of 25° with respect the vertical direction and the test body were adjusted so that the distance from the tip end of the Bunsen burner to the center of a lower end of the test body was 17 mm. Then, flame was brought into contact with the sample. When the sample was ignited, a time was counted with a stopwatch. After 12 seconds from the ignition, the burner was detached from the sample. Then, a weight (0.25 pounds) was hung on one side of a carbonized portion of the test body after the test, and the other side was held and raised slowly. The distance from the other end to a broken portion was measured to be a carbonized length. The case where the maximum carbonized length was less than 254 mm and the average thereof was 178 mm or less was determined to pass the test, and the other cases were determined to fail the test.

(Method for Measuring a Fiber Shrinkage)

A portion of about 5 mm was taken from halogen-containing fibers 3333 dtex (decitex) produced in accordance with the above production example and measured by TMA (dynamic load thermomechanical analyzer ("TMA/SS150C" (trade name) manufactured by Seiko Instruments & Electronics Ltd.), gas to be used: nitrogen, flow rate of gas: 30 L/min., temperature rise speed: 20° C./min., load: 18 mN). Assuming that the initial sample length is X and the sample length at an arbitrary temperature is Y, the fiber shrinkage is represented by the following expression. The flame retardant synthetic fiber of the present invention remaining without being broken when a temperature is raised from 50° C. to 300° C. under a load of 0.0054 mN/dtex means the following: in the case where the fiber shrinkage (which also may be merely referred to as a shrinkage in the present specification) is measured by the above measurement method while a temperature is raised from 50° C. to 300° C. under a load of 0.054 mN/dtex, the flame retardant synthetic fiber of the present invention remains without being broken.

$$\text{Fiber shrinkage (\%)}=100-[(100\times Y)/X]$$

(Filament Strength)

The filament strength of the halogen-containing fibers produced in accordance with the above production example was measured pursuant to JIS L 1015.

(Elongation)

The elongation of the halogen-containing fibers produced in accordance with the above production example was measured pursuant to JIS L 1015.

Examples 1-33

Halogen-containing fibers with a metal compound (2-1), a metal compound (2-2), and an epoxy-containing compound added thereto in the amounts shown in above Table 2 were produced in accordance with the above Production Examples 1-33. The filament strength, elongation, and fiber shrinkage of the halogen-containing fibers in Production Examples 1-33 thus obtained were measured as described above. Table 4 shows the filament strength, elongation, and the results of shrinkage variations and shrinkage patterns when a temperature is raised from 50° C. to 300° C. under a load of 0.0054 mN/dtex, obtained by measuring fiber shrinkage. Further, using the halogen-containing fibers in Production Examples 1-33, thermally bonded nonwoven fabric for a flame retardance evaluation test was produced at a predetermined mixed ratio (halogen-containing fibers:regular polyester fibers (reg. PET):melt polyester fibers (mPET)=50:30:20 (mass ratio), basis weight: 280 g/m$^2$). Using a pillow top mattress test body using the nonwoven fabric, flame retardance was evaluated by a panel test evaluation method. Table 4 shows the results. The fibers obtained in Production Examples 1-33 correspond to Examples 1-33, respectively.

TABLE 4

| | Halogen-containing fiber | | | | | |
|---|---|---|---|---|---|---|
| Experiment No. | Production Example | Filament strength (cN/dtex) | Elongation (%) | Shrinkage pattern at 50° C. to 300° C. | Shrinkage variation at 50° C. to 300° C. (%) | Mattress test performance (halogen-containing fiber/reg.PET/mPET = 50/30/20) |
| Example 1 | 1 | 0.94 | 62 | FIG. 10 | 30 | D |
| Example 2 | 2 | 0.64 | 68 | FIG. 10 | 33 | B |
| Example 3 | 3 | 0.78 | 65 | FIG. 6 | 37 | C |
| Example 4 | 4 | 0.91 | 66 | FIG. 6 | 37 | B |
| Example 5 | 5 | 0.85 | 70 | FIG. 6 | 38 | B |
| Example 6 | 6 | 0.81 | 73 | FIG. 6 | 31 | A |
| Example 7 | 7 | 0.66 | 75 | FIG. 6 | 29 | A |
| Example 8 | 8 | 0.78 | 65 | FIG. 6 | 29 | A |
| Example 9 | 9 | 0.64 | 68 | FIG. 6 | 40 | C |
| Example 10 | 10 | 0.91 | 66 | FIG. 6 | 40 | B |
| Example 11 | 11 | 0.78 | 65 | FIG. 6 | 39 | A |
| Example 12 | 12 | 0.87 | 60 | FIG. 9 | 15 | B |
| Example 13 | 13 | 0.92 | 57 | FIG. 6 | 41 | C |
| Example 14 | 14 | 0.74 | 51 | FIG. 6 | 44 | C |
| Example 15 | 15 | 0.86 | 66 | FIG. 6 | 36 | A |
| Example 16 | 16 | 0.67 | 75 | FIG. 6 | 38 | A |
| Example 17 | 17 | 0.64 | 71 | FIG. 6 | 38 | A |
| Example 18 | 18 | 0.81 | 73 | FIG. 6 | 38 | C |
| Example 19 | 19 | 1.08 | 66 | FIG. 10 | 33 | D |
| Example 20 | 20 | 0.81 | 72 | FIG. 10 | 43 | C |
| Example 21 | 21 | 0.55 | 68 | FIG. 6 | 41 | C |
| Example 22 | 22 | 0.78 | 66 | FIG. 6 | 31 | A |
| Example 23 | 23 | 0.85 | 69 | FIG. 6 | 31 | A |
| Example 24 | 24 | 0.85 | 70 | FIG. 6 | 30 | A |
| Example 25 | 25 | 0.81 | 73 | FIG. 6 | 28 | A |
| Example 26 | 26 | 0.88 | 79 | FIG. 6 | 20 | B |
| Example 27 | 27 | 0.94 | 74 | FIG. 6 | 42 | B |
| Example 28 | 28 | 0.78 | 65 | FIG. 6 | 32 | A |
| Example 29 | 29 | 0.85 | 68 | FIG. 6 | 31 | A |
| Example 30 | 30 | 0.85 | 70 | FIG. 6 | 31 | A |
| Example 31 | 31 | 0.55 | 71 | FIG. 6 | 30 | A |
| Example 32 | 32 | 0.88 | 78 | FIG. 6 | 20 | A |
| Example 33 | 33 | 0.94 | 62 | FIG. 6 | 38 | B |
| Comparative Example 1 | 34 | 0.77 | 64 | FIG. 12 | 47 | Fail |
| Comparative Example 2 | 35 | 0.78 | 65 | FIG. 10 | 28 | Fail |
| Comparative Example 3 | 36 | 1.4 | 48 | FIG. 8 | 67 | Fail |
| Comparative Example 4 | 37 | 2.7 | 24 | FIG. 8 | 48 | Fail |
| Comparative Example 5 | 38 | 2.3 | 23 | FIG. 12 | 93 | Fail |
| Comparative Example 6 | 39 | 1.8 | 32 | FIG. 8 | 62 | Fail |
| Comparative Example 7 | 40 | 1.65 | 34 | FIG. 12 | 68 | Fail |
| Comparative Example 8 | 41 | 1.51 | 38 | FIG. 12 | 63 | Fail |
| Comparative Example 9 | 42 | 1.7 | 36 | FIG. 8 | 65 | Fail |
| Comparative Example 10 | 43 | 0.73 | 71 | FIG. 12 | 46 | Fail |
| Comparative Example 11 | 44 | 2.01 | 40 | FIG. 12 | 160 | Fail |
| Comparative Example 12 | 45 | 1.95 | 34 | FIG. 8 | 73 | Fail |
| Comparative Example 13 | 46 | 2.2 | 25 | FIG. 12 | 72 | Fail |
| Comparative Example 14 | 47 | 3 | 21 | FIG. 7 | ∞ | Fail |
| Comparative Example 15 | 48 | 1.65 | 34 | FIG. 12 | 68 | Fail |

Figure 13A:
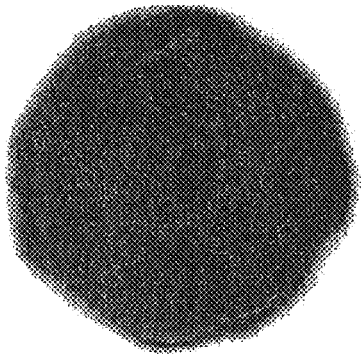
FIG. 13A is a photograph showing the state after a stove test of a thermally bonded nonwoven fabric that is a test body for evaluating flame retardance in Example 6.

In Examples 1-9, the halogen-containing fibers contained 0.05 to 50 parts by mass of the metal oxide (2), in particular, 0.05 to 50 parts by mass of the metal compound (2-1) based on 100 parts by mass of the polymer (1), and were subjected to relaxation treatment in an unstretched state at 123° C. for 15 minutes in wet-heat pressure steam. The shrinkage variation of the halogen-containing fibers became 45% or less when a temperature was raised from 50° C. to 300° C. under a load of 0.0054 mN/dtex. Thus, the burning test results using the test bodies for evaluating flame retardance were satisfactory, and the pass/fail determination was a pass. Further, the following was found from the results in Tables 2-4 in Examples 5-8. In the case where the halogen-containing fibers contain the metal compound (2-1) and the metal oxide (2) in the same contents, based on 100 parts by mass of the polymer (1), the shrinkage variation at a time when a temperature is raised from 50° C. to 300° C. under a load of 0.0054 mN/dtex is lower and the passing rank of the burning test result using the test body for evaluating flame retardance is higher in Examples 6-8 further using the halogen-containing fibers in Production Examples 6-8 containing 0.1 to 20 parts by mass of the epoxy-containing compound based on 100 parts by mass of the polymer (1), compared with Example 5 using the halogen-containing fibers in Production Example 5 containing no epoxy-containing compound. Further, the following is found from the comparison between the results of Examples 1 and 2 and the comparison between the results of Examples 3 and 4 in Tables 2-4. In the case where the halogen fibers contain the metal compound (2-1) in the same content based on 100 parts by mass of the polymer (1), when the halogen fibers further contain the metal compound (2-2), the passing rank of the burning test result using the test body for evaluating flame retardance is higher. FIG. 13A shows the state after the stove test of the thermally bonded nonwoven fabric that is a test body for evaluating flame retardance in Example 6.

In Examples 10-12, the halogen-containing fibers contained 0.05 to 50 parts by mass of the metal oxide (2), in particular 0.05 to 50 parts by mass of the metal compound (2-1) based on 100 parts by mass of the polymer (1) and were subjected to dry-heat treatment in an unstretched state at 170° C. for 2 minutes. The shrinkage variation became 45% or less when a temperature was raised from 50° C. to 300° C. under a load of 0.0054 mN/dtex. Thus, the burning test result using the test body for evaluating flame retardance was satisfactory, and the pass/fail determination was a pass.

In Example 12, as described above, the burning test result using the test body for evaluating flame retardance was satisfactory, and the pass/fail determination was a pass. However, a copolymer containing 38% acrylonitrile, 61.1% vinylidene chloride, and 0.9% p-sodium styrenesulfonate was used as the halogen-containing fibers; therefore, the heat resistance was poor compared with those of the other examples, and at a time of spinning, particularly, during relaxation treatment, the fibers fused to each other to become hard. As a result, openability was poor in the course of production of the nonwoven fabric for evaluating flame retardance, and nonwoven fabric in which the halogen-containing fibers, the polyester fibers, and the heat-fusible polyester fibers were mixed uniformly was not produced.

In Example 13, the halogen-containing fibers contained 0.05 to 50 parts by mass of the metal oxide (2), in particular 0.05 to 50 parts by mass of the metal compound (2-1) based on 100 parts by mass of the polymer (1) and were subjected to dry-heat treatment in a stretched state at 185° C. for 2 minutes. The shrinkage variation became 45% or less when a temperature was raised from 50° C. to 300° C. under a load of 0.0054 mN/dtex. Thus, the burning test result using the test body for evaluating flame retardance was satisfactory, and the pass/fail determination was a pass.

In Example 14, the halogen-containing fibers contained 0.05 to 50 parts by mass of the metal oxide (2), in particular 0.05 to 50 parts by mass of the metal compound (2-1) based on 100 parts by mass of the polymer (1) and were subjected to wet-heat stretched treatment at 150° C. for 15 minutes. The shrinkage variation became 45% or less when a temperature was raised from 50° C. to 300° C. under a load of 0.0054 mN/dtex. Thus, the burning test result using the test body for evaluating flame retardance was satisfactory, and the pass/fail determination was a pass.

In Example 15, the halogen-containing fibers contained 0.05 to 50 parts by mass of the metal oxide (2), in particular 0.05 to 50 parts by mass of the metal compound (2-1) based on 100 parts by mass of the polymer (1), further contained the epoxy-containing compound, and were subjected to relaxation treatment in an unstretched state at 123° C. for 10 minutes in wet-heat pressure steam. The shrinkage variation became 45% or less when a temperature was raised from 50° C. to 300° C. Thus, the burning test result using the test body for evaluating flame retardance was satisfactory, and the pass/fail determination was a pass.

In Example 16, although the cresol novolac epoxy resin was used in place of polyglycidyl methacrylate as the epoxy-containing compound, the shrinkage variation became 45% or less when a temperature was raised from 50° C. to 300° C. under a load of 0.0054 mN/dtex. Thus, the burning test result using the test body for evaluating flame retardance was satisfactory, and the pass/fail determination was a pass.

In Examples 17 and 18, although antimony pentoxide and copper iodide were used respectively in place of antimony trioxide as the metal compound (2-2), the shrinkage variation became 45% or less when a temperature was raised from 50° C. to 300° C. under a load of 0.0054 mN/dtex. Thus, the burning test result using the test body for evaluating flame retardance was satisfactory, and the pass/fail determination was a pass.

In Examples 19 and 20, although tin oxide and zinc carbonate were used respectively in place of zinc oxide as the metal compound (2-1), the shrinkage variation became 45% or less when a temperature was raised from 50° C. to 300° C. under a load of 0.0054 mN/dtex. Thus, the burning test result using the test body for evaluating flame retardance was satisfactory, and the pass/fail determination was a pass.

In Examples 21-33, the halogen-containing fibers contained 0.05 to 50 parts by mass of the metal oxide (2), in particular 0.05 to 50 parts by mass of the metal compound (2-1) based on 100 parts by mass of the polymer (1) and were subjected to relaxation treatment in an unstretched state under the condition described in Table 3, for example, at 110° C.-130° C. for 5-30 minutes in wet-heat pressure steam. The shrinkage variation became 45% or less when a temperature was raised from 50° C. to 300° C. under a load of 0.0054 mN/dtex. Thus, the burning test result using the test body for evaluating flame retardance was satisfactory, and the pass/fail determination was a pass.

The halogen-containing fibers in Examples 1-33, which achieved the shinkage variation of 45% or less when a temperature was raised from 50° C. to 300° C. under a load of 0.0054 mN/dtex and which achieved high flame retardance, had a filament strength in a range of 0.5 to 1.6 cN/dtex and an elongation in a range of 50 to 90%, which those skilled in the art would not use in ordinary applications.

Comparative Examples 1-15

Halogen-containing fibers with the metal compound (2-1), the metal compound (2-2), and the epoxy-containing compound added thereto in the amounts shown in Table 2 were produced in accordance with Production Examples 34-48. The filament strength, elongation, and fiber shrinkage of the halogen-containing fibers in Production Examples 34-48 thus obtained were measured as described above. Table 4 shows the filament strength, elongation, and the results of shrinkage variations and shrinkage patterns when a temperature is raised from 50° C. to 300° C. under a load of 0.0054 mN/dtex, obtained by measuring fiber shrinkage. Further, using the halogen-containing fibers in Production Examples 34-48, thermally bonded nonwoven fabric for a flame retardance evaluation test was produced at a predetermined mixed ratio halogen-containing fibers:regular polyester fibers (reg. PET): melt polyester fibers (mPET)=50:30:20 (mass ratio), basis weight: 280 g/m$^2$). Using a pillow top mattress test body using the nonwoven fabric, flame retardance was evaluated by a panel test evaluation method. Table 4 shows the results. The fibers obtained in Production Examples 34-48 correspond to Comparative Examples 1-15, respectively.

Figure 13B:
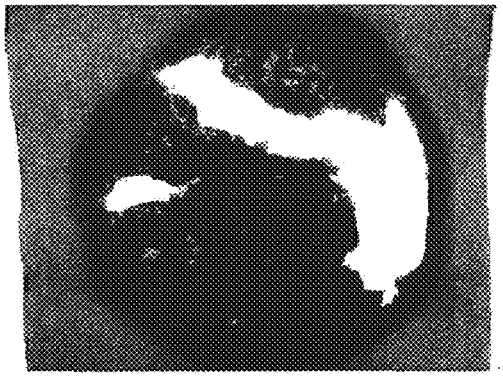
FIG. 13B is a photograph showing the state after a stove test of a thermally bonded nonwoven fabric that is a test body for evaluating flame retardance in Comparative Example 3.
Figure 13C:
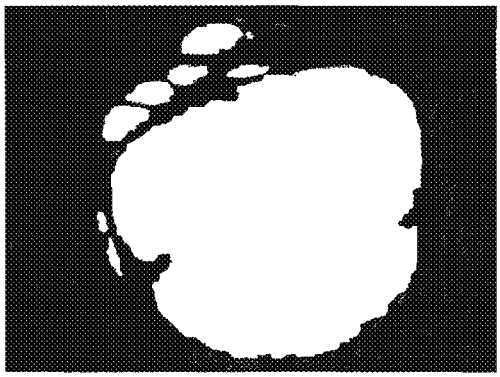
FIG. 13C is a photograph showing the state after a stove test of a thermally bonded nonwoven fabric that is a test body for evaluating flame retardance in Comparative Example 1.

In Comparative Example 1, although the relaxation heat treatment was performed, the halogen-containing fibers did not contain the metal compound (2-1), so that the shrinkage variation at a time when a temperature was raised from 50° C. to 300° C. under a load of 0.0054 mN/dtex was 47% which exceeded 45%. Therefore, in the burning test evaluation using a test body for evaluating flame retardance, a hole was formed in the nonwoven fabric for evaluating flame retardance used in the test body for evaluating flame retardance during the burning test, internal inflammable urethane was ignited, and the flame was extinguished force fully to stop the test, resulting in a fail. FIG. 13C shows the state of the thermally bonded nonwoven fabric that is the test body for evaluating flame retardance in Comparative Example 1 after the stove test.

In Comparative Example 2, although the shrinkage variation was 28%, which was equal to or less than 45%, the halogen-containing fibers did not contain the metal compound (2-1); therefore, in the burning test evaluation using the test body for evaluating flame retardance, a hole was formed in the nonwoven fabric for evaluating flame retardance used in the test body for evaluating flame retardance during the burning test, internal inflammable urethane was ignited, and the flame was extinguished forcefully to stop the test, resulting in a fail.

In Comparative Example 3, although the halogen-containing fibers contained zinc oxide as the metal compound (2-1), the shrinkage variation at a time when a temperature was raised from 50° C. to 300° C. under a load of 0.0054 mN/dtex was 67% which exceeded 45% due to the dry-heat treatment in a stretched state at 170° C. for 2 minutes. Therefore, during the burning test, cracks were generated in the test body, and fire entered therethrough to ignite internal inflammable urethane, resulting in that the pass/fail determination was a fail. FIG. 13B shows the state of the thermally bonded nonwoven fabric that is the test body for evaluating flame retardance in Comparative Example 3 after the stove test.

In Comparative Example 4, although the halogen-containing fibers contained zinc oxide as the metal compound (2-1), the shrinkage variation at a time when a temperature was raised from 50° C. to 300° C. under a load of 0.0054 mN/dtex was 48% which exceeded 45% due to the wet-heat treatment in a stretched state at 140° C. for 15 minutes. Therefore, during the burning test, cracks were generated in the test body, and fire entered therethrough to ignite internal inflammable urethane, resulting in a fail.

In Comparative Examples 5 and 7, the halogen-containing fibers did not contain the metal compound (2-1), and the wet-heat treatment was performed in a stretched state at 130° C. for 15 minutes. Therefore, the shrinkage variation at a time when a temperature was raised from 50° C. to 300° C. under a load of 0.0054 mN/dtex was 93% and 68%, respectively, which exceeded 45%. Therefore, in the burning test evaluation using the test body for evaluating flame retardance, a hole was formed in the nonwoven fabric for evaluating flame retardance used as the test body for evaluating flame retardance during the burning test, internal inflammable urethane was ignited, and the flame was extinguished forcefully to stop the test, resulting in a fail.

In Comparative Example 6, although the halogen-containing fibers contained metastannic acid as the metal compound (2-1), the shrinkage variation at a time when a temperature was raised from 50° C. to 300° C. under a load of 0.0054 mN/dtex was 62% which exceeded 45% due to the wet-heat treatment in a stretched state at 130° C. for 15 minutes. Therefore, during the burning test, cracks were generated in the test body, and fire entered therethrough to ignite internal inflammable urethane, resulting in a fail.

In Comparative Example 8, although the halogen-containing fibers had a total stretching ratio at a time of spinning of less than 4.5 times, the shrinkage variation at a time when a temperature was raised from 50° C. to 300° C. under a load of 0.0054 mN/dtex was 63% which exceeded 45% due to the wet-heat treatment in a stretched state at 130° C. for 15 minutes and further the absence of the metal compound (2-1). Therefore, in the burning test evaluation using the test body for evaluating flame retardance, a hole was formed in the nonwoven fabric for evaluating flame retardance used in the test body for evaluating flame retardance during the burning test, internal inflammable urethane was ignited, and the flame was extinguished forcefully to stop the test, resulting in a fail.

In Comparative Example 9, although the halogen-containing fibers contained zinc oxide as the metal compound (2-1), the shrinkage variation at a time when a temperature was raised from 50° C. to 300° C. under a load of 0.0054 mN/dtex was 65% which exceeded 45% due to the wet-heat treatment in a stretched state at 130° C. for 2 minutes. Therefore, during the burning test, cracks were generated in the test body, and fire entered therethrough to ignite internal inflammable urethane, resulting in that the pass/fail determination was a fail.

In Comparative Example 10, although the halogen-containing fibers contained aluminum hydroxide as the metal compound, the shrinkage variation at a time when a temperature was raised from 50° C. to 300° C. under a load of 0.0054 mN/dtex was 46% which exceeded 45% due to the absence of the metal compound (2-1). Therefore, in the burning test evaluation using the test body for evaluating flame retardance, a hole was formed in the nonwoven fabric for evaluating flame retardance used in the test body for evaluating flame retardance during the burning test, internal inflammable urethane was ignited, and the flame was extinguished forcefuly to stop the test, resulting in a fail.

Comparative Example 11

Comparative Example 11 is a comparative example that is a retest of the example in JP 2004-197255 A. JP 2004-197255 A is prior art regarding the patent application filed by the applicant of the present application. In Comparative Example 11, the production conditions of halogen-containing fibers, which are not described specifically in JP 2004-197255 A, such as a primary stretching ratio, a secondary stretching ratio, a heat treatment relaxation ratio, and a heat treatment method, are presumed from the production conditions of the halogen-containing fibers, used by the applicant of the present application at a time of filing of JP 2004-197255 A. As is understood from Table 4, the shrinkage variation at a time when a temperature was raised from 50° C. to 300° C. under a load of 0.0054 mN/dtex exceeded 45%. Therefore, in the burning test evaluation using the test body for evaluating flame retardance, a hole was formed in the nonwoven fabric for evaluating flame retardance used in the test body for evaluating flame retardance during the burning test, internal inflammable urethane was ignited, and the flame was extinguished forcefully to stop the test, resulting in a fail.

Comparative Example 12

Comparative Example 12 is a comparative example that is a retest of the example in WO 01/32968. WO 01/32968 is prior art regarding the patent application filed by the applicant of the present application. In Comparative Example 12, the production conditions of halogen-containing fibers, which are not described specifically in WO 01/32968, such as a primary stretching ratio, a heat treatment relaxation ratio, and a heat treatment method, are presumed from the production conditions of the halogen-containing fibers, used by the applicant of the present application at a time of filing of WO 01/32968. As is understood from Table 4, in Comparative Example 12, the shrinkage variation at a time when a temperature was raised from 50° C. to 300° C. under a load of 0.0054 mN/dtex exceeded 45%. Therefore, in the burning test evaluation using the test body for evaluating flame retardance, cracks were generated in the nonwoven fabric for evaluating flame retardance used in the test body for evaluating flame retardance during the burning test, fire entered therethrough to ignite internal inflammable urethane, and the flame was extinguished forcefully to stop the test, resulting in a fail.

Comparative Example 13

Comparative Example 13 is a comparative example that is a retest of the example in JP 61 (1986)-282420 A. In Comparative Example 13, the production conditions of halogen-containing fibers, which are not described specifically in JP 61 (1986)-282420 A, such as a primary stretching ratio, a secondary stretching ratio, a heat treatment relaxation ratio, and a heat treatment method, are presumed with reference to various patent documents of the applicant of JP 61 (1986)-282420 A. As is understood from Table 4, in Comparative Example 13, the shrinkage variation at a time when a temperature was raised from 50° C. to 300° C. under a load of 0.0054 mN/dtex exceeded 45%. Therefore, in the burning test evaluation using the test body for evaluating flame retardance, a hole was formed in the nonwoven fabric for evaluating flame retardance used in the test body for evaluating flame retardance during the burning test, internal inflammable urethane was ignited, and flame was extinguished forcefully to stop the test, resulting in a fail.

Comparative Example 14

Comparative Example 14 is a comparative example that is a retest of the example in JP 53(1978)-106825 A JP 53(1978)-106825 A is prior art regarding the patent application filed by the applicant of the present application. In Comparative Example 14, the production conditions of halogen-containing fibers, which are not described specifically in JP 53(1978)-106825 A, such as a primary stretching ratio, a heat treatment relaxation ratio, and a heat treatment method, are presumed from the production conditions of the halogen-containing fibers, used by the applicant of the present application at a time of filing of JP 53(1978)-106825 A. As is understood from Table 4, in Comparative Example 14, the shrinkage variation at a time when a temperature was raised from 50° C. to 300° C. under a load of 0.0054 mN/dtex exceeded 45%. Therefore, in the burning test evaluation using the test body for evaluating flame retardance, a hole was formed in the nonwoven fabric for evaluating flame retardance used in the test body for evaluating flame retardance during the burning test, internal inflammable urethane was ignited, and the flame was extinguished forcefully to stop the test, resulting in a fail.

Comparative Example 15

Comparative Example 15 is a comparative example that is a retest of the example in JP 6(1994)-287806 A. In Comparative Example 15, the production conditions of halogen-containing fibers, which are not described specifically in JP 6(1994)-287806 A, such as a primary stretching ratio, a heat treatment relaxation ratio, and a heat treatment method, are presumed with reference to JP 1(1989)-29888 B that is the patent document of the applicant of JP 6(1994)-287806 A As is understood from Table 4, in Comparative Example 15, the shrinkage variation at a time when a temperature was raised from 50° C. to 300° C. under a load of 0.0054 mN/dtex exceeded 45%. Therefore, in the burning test evaluation using the test body for evaluating flame retardance, a hole was formed in the nonwoven fabric for evaluating flame retardance used in the test body for evaluating flame retardance during the burning test, internal inflammable urethane was ignited, and the flame was extinguished forcefully to stop the test, resulting in a fail.

Further, in Comparative Examples 1-15, the filament strength of all the halogen-containing fibers exceeded 1.6 cN/dtex, and the elongation thereof was less than 50%.

Examples 34-60, Comparative Examples 16-31

In Examples 34-60, the mixed ratio of the halogen-containing fibers produced by Production Example 5 or 11 that is an example of the flame retardant synthetic fibers of the present invention in the flame retardant fiber mixture was 10% or more, and irrespective of the kinds of the other fibers contained in the flame retardant fiber mixture and the configurations of products, excellent flame retardance performance was exhibited in various tests, resulting in a pass in every test. On the other hand, Comparative Examples 16-25 using the halogen-containing fibers produced in accordance with Production Example 35 containing no metal compound (2-1) that accelerated the carbonization during burning of the polymer (1) resulted in a fail in every test. Further, in Comparative Examples 26-31, although the halogen-containing fibers produced in accordance with Production Example 5 that was an example of the flame retardant synthetic fibers of the present invention were used, the mixed ratio of the halogen-containing fibers in the fiber mixture was less than 10%, so that Comparative Examples 26-31 resulted in a fail in any test.

Table 5 shows the results of the flame retardant burning test in Examples 34-60 and Comparative Examples 16-31.

TABLE 5

| Experiment No. | Production example of halogen-containing fiber | Mixture: Form of mixture | Mixture: Halogen-containing fibers (part by mass) | Mixture: reg.PET (part by mass) | Mixture: melt PET (part by mass) | Mixture: Other fibers (part by mass) | Mixture: Basis weight (g/m$^2$) | Product: Form of product | Product: Cover | Method for evaluating mixture and product: Panel test | Method for evaluating mixture and product: Stove test | Method for evaluating mixture and product: TB604 (pillow) | Method for evaluating mixture and product: JIS L 1091 A-4 |
|---|---|---|---|---|---|---|---|---|---|---|---|---|---|
| Example 34 | 5 | Thermal bond | 50 | 30 | 20 | | 280 | Pillow top mattress | PET | A | | | |
| Example 35 | 5 | Thermal bond | 50 | 30 | 20 | | 280 | Pillow top mattress | Rayon/PP | A | | | |
| Example 36 | 5 | Thermal bond | 50 | 30 | 20 | | 280 | Pillow top mattress | cotton | A | | | |
| Example 37 | 5 | Thermal bond | 50 | | 20 | 30 (Rayon) | 280 | Pillow top mattress | PET/PP | C | | | |
| Example 38 | 5 | Thermal bond | 50 | | 20 | 30 (Kevler) | 280 | Pillow top mattress | PET/PP | A | | | |
| Example 39 | 5 | Thermal bond | 50 | | 20 | 30 (Visil) | 280 | Pillow top mattress | PET/PP | A | | | |
| Example 40 | 5 | Thermal bond | 20 | 60 | 20 | | 320 | Pillow top mattress | PET/PP | D | | | |
| Example 41 | 5 | Thermal bond | 80 | | 20 | | 280 | Pillow top mattress | PET/PP | C | | | |
| Example 42 | 5 | Thermal bond | 10 | 70 | 20 | | 360 | Pillow top mattress | Rayon/PP | C | | | |
| Example 43 | 5 | Thermal bond | 90 | | 10 | | 200 | Pillow top mattress | PET | A | | | |
| Example 44 | 5 | Thermal bond | 10 | 70 | 20 | | 330 | Tight top mattress | PET | C | | | |
| Example 45 | 5 | Thermal bond | 90 | | 10 | | 250 | Tight top mattress | PET | A | | | |
| Example 46 | 5 | Needle punch | 20 | 80 | | | 330 | Pillow top mattress | PET | B | | | |
| Example 47 | 5 | Needle punch | 80 | 20 | | | 250 | Pillow top mattress | PET | C | | | |
| Example 48 | 5 | Needle punch | 40 | | | 60 (cotton) | 120 | Assuming textile | — | | | | Pass |
| Example 49 | 5 | Needle punch | 30 | 70 | | | 300 | Nonwoven fabric | — | | Pass | | |
| Example 50 | 5 | Filling material | 10 | 90 | | | — | Pillow | cotton/PET | | | Pass | |
| Example 51 | 5 | Knit | 20 | | | 60 (cotton) | 120 | Textile | — | | | | Pass |
| Example 52 | 11 | Thermal bond | 50 | 30 | 20 | | 260 | Pillow top mattress | Rayon/PP | A | | | |
| Example 53 | 11 | Thermal bond | 50 | 30 | 20 | | 260 | Pillow top mattress | PET | A | | | |
| Example 54 | 11 | Thermal bond | 20 | 60 | 20 | | 360 | Pillow top mattress | PET/PP | B | | | |
| Example 55 | 11 | Thermal bond | 10 | 70 | 20 | | 330 | Tight top mattress | Rayon/PP | C | | | |
| Example 56 | 11 | Needle punch | 50 | 50 | | | 200 | Tight top mattress | Rayon/PP | A | | | |
| Example 57 | 11 | Needle punch | 40 | | | 60 (cotton) | 120 | Assuming textile | — | | | | Pass |
| Example 58 | 11 | Needle punch | 30 | 50 | 20 | | 300 | Nonwoven fabric | — | | Pass | | |
| Example 59 | 11 | Filling material | 10 | 90 | | | — | Pillow | cotton/PET | | | Pass | |
| Example 60 | 11 | Knit | 40 | | | 60 (cotton) | 120 | Textile | — | | | | Pass |
| Comparative Example 16 | 35 | Thermal bond | 20 | 60 | 20 | | 280 | Pillow top mattress | PET/PP | Fail | | | |
| Comparative Example 17 | 35 | Thermal bond | 80 | 0 | 20 | | 280 | Pillow top mattress | PET/PP | Fail | | | |
| Comparative Example 18 | 35 | Thermal bond | 10 | 70 | 20 | | 330 | Tight top mattress | PET/PP | Fail | | | |
| Comparative Example 19 | 35 | Thermal bond | 90 | | 10 | | 250 | Tight top mattress | PET/PP | Fail | | | |
| Comparative Example 20 | 35 | Needle punch | 20 | 80 | | | 330 | Pillow top mattress | PET/PP | Fail | | | |
| Comparative Example 21 | 35 | Needle punch | 80 | 20 | | | 250 | Pillow top mattress | PET/PP | Fail | | | |
| Comparative Example 22 | 35 | Needle punch | 40 | | | 60 (cotton) | 120 | Assuming textile | — | | | | Fail |
| Comparative Example 23 | 35 | Needle punch | 30 | 70 | | | 300 | Nonwoven fabric | — | | Fail | | |
| Comparative Example 24 | 35 | Filling material | 10 | 90 | | | — | Pillow | cotton/PET | | | Fail | |
| Comparative Example 25 | 35 | Knit | 40 | | | 60 (cotton) | 120 | Textile | — | | | | Fail |
| Comparative Example 26 | 5 | Thermal bond | 5 | 75 | 20 | | 280 | Pillow top mattress | PET/PP | Fail | | | |
| Comparative Example 27 | 5 | Thermal bond | 5 | 75 | 20 | | 280 | Tight top mattress | PET/PP | Fail | | | |
| Comparative Example 28 | 5 | Needle punch | 5 | 75 | 20 | | 280 | Pillow top mattress | PET/PP | Fail | | | |

TABLE 5-continued

| Experiment No. | Production example of halogen-containing fiber | Mixture: Form of mixture | Mixture: Halogen-containing fibers (part by mass) | Mixture: reg.PET (part by mass) | Mixture: melt PET (part by mass) | Mixture: Other fibers (part by mass) | Basis weight ($g/m^2$) | Product: Form of product | Product: Cover | Method for evaluating mixture and product: Panel test | Stove test | TB604 (pillow) | JIS L 1091 A-4 |
|---|---|---|---|---|---|---|---|---|---|---|---|---|---|
| Comparative Example 29 | 5 | Needle punch | 5 | 95 | | | 300 | Nonwoven fabric | — | | Fail | | |
| Comparative Example 30 | 5 | Filling material | 5 | 95 | | | — | Pillow | cotton/PET | | | Fail | |
| Comparative Example 31 | 5 | Knit | 5 | | | 95 (cotton) | 120 | Textile | — | | | | Fail |

Figure 5:
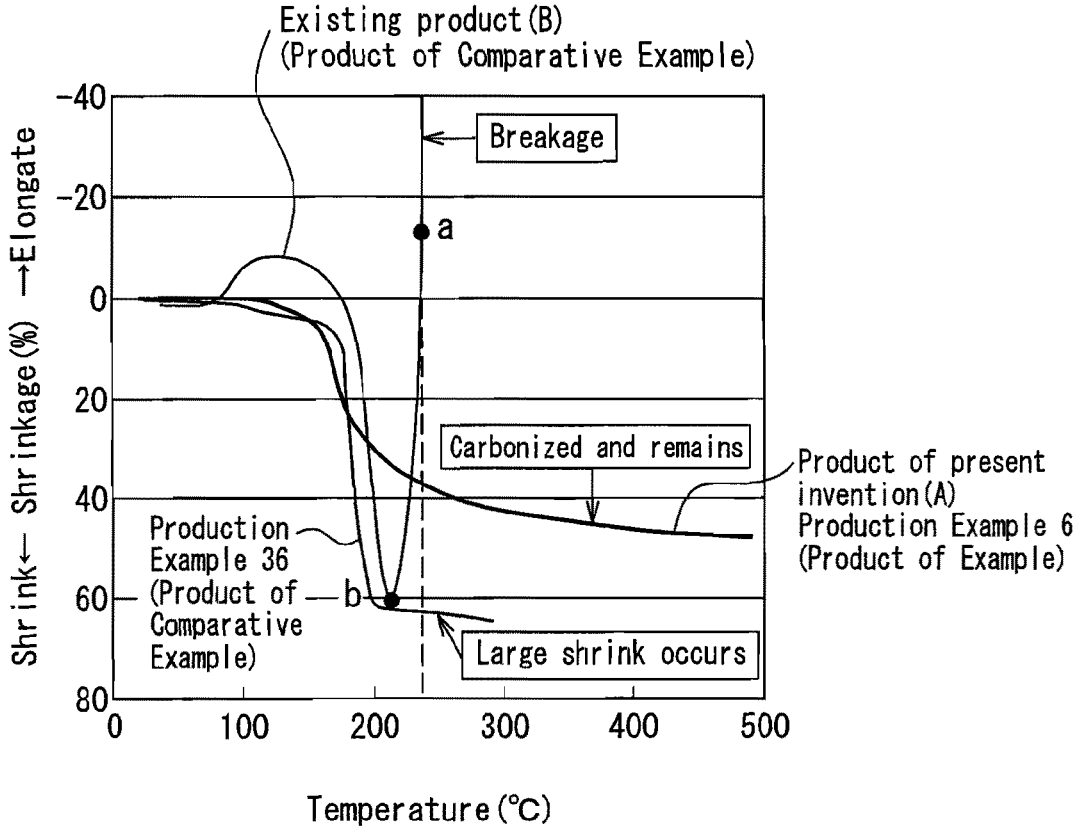
FIG. 5 is a graph showing shrinkage behavior when a halogen-containing fiber obtained in Production Example 6 that is an example product of the present invention and a fiber of a comparative example product are heated.

FIG. 5 shows the results obtained by taking about 5 mm each of 3333 dtex (decitex) of the halogen-containing fibers (A) obtained in Production Example 6 that is an example of the flame retardant synthetic fibers of the present invention, modacrylic fibers of the existing product ("Protex-M" (trade name) manufactured by Kaneka Corporation), and the halogen-containing fibers (C) obtained in accordance with Production Example 36 that is a comparative example product in the present invention, and measuring the shrinkage behavior at a temperature from 50° C. to 300° C. or higher in a nitrogen atmosphere at a temperature rise speed of 20° C./min under a load of 18 mN (corresponding to the tension applied to an ordinary product). The existing product (B) as the comparative example product starts shrinkage in the vicinity of a temperature higher than about 180° C., reaches a peak at around 205° C., and thereafter, elongates to be broken at around 250° C. Further, the fibers (C) obtained in Production Example 36 as the comparative example product largely shrinks at a temperature in a range of higher than about 180° C. up to about 200° C. In contrast, the fibers (A) obtained in Production Example 6 that is the product of the present invention starts shrinkage gradually at a temperature higher than about 170° C.; however, the fibers (A) have a shrinkage lower than that of the fibers (C) and are carbonized and remain without being broken.

DESCRIPTION OF THE REFERENCE NUMERALS

1, 2, 6 Polyurethane foam
3 Nonwoven fabric
4 Outer layer surface textile
5 Nylon yarn

What is claimed is:

1. A flame retardant synthetic fiber, comprising:

a polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer; and at least one kind of a metal compound (2) that accelerates a dehalogenation reaction of the polymer (1) during burning and a carbonization reaction of the polymer (1) during burning, wherein the flame retardant synthetic fiber has a shrinkage variation of 45% or less when a temperature is raised from 50° C. to 300° C. under a load of 0.0054 mN/dtex.

2. The flame retardant synthetic fiber according to claim 1, having a filament strength of 0.5 to 1.6 cN/dtex and an elongation of 50 to 90%.

3. The flame retardant synthetic fiber according to claim 1, wherein the flame retardant synthetic fiber remains without being broken when the temperature is raised from 50° C. to 300° C. under a load of 0.0054 mN/dtex.

4. The flame retardant synthetic fiber according to claim 1, which is produced by extruding a spinning solution, followed by primary stretching, washing with water, drying, secondary stretching, and heat treatment under a condition that a total stretching ratio obtained by multiplying a stretching ratio during the stretching by a relaxation ratio that is a ratio at which the fiber shrinks during the heat treatment is 4.5 times or less.

5. The flame retardant synthetic fiber according to claim 1, comprising 0.05 to 50 parts by mass of the metal compound (2), based on 100 parts by mass of the polymer (1).

6. The flame retardant synthetic fiber according to claim 1, wherein the metal compound (2) is composed of a metal compound (2-1) that accelerates both the dehalogenation reaction and the carbonization reaction, or a combination of the metal compound (2-1) and a metal compound (2-2) that accelerates the dehalogenation reaction.

7. The flame retardant synthetic fiber according to claim 6, comprising 5 to 30 parts by mass of the metal compound (2-2), based on 100 parts by mass of the polymer (1).

8. The flame retardant synthetic fiber according to claim 6, wherein the metal compound (2-1) is at least one selected from the group consisting of zinc oxide, zinc carbonate, zinc sulfide, zinc borate, zinc stannate, metastannic acid, tungsten oxide, zirconium oxide, tin oxide, copper oxide, copper phosphate, indium trioxide, barium titanate, and zinc para-toluenesulnate.

9. The flame retardant synthetic fiber according to claim 8, wherein the metal compound (2-1) is at least one selected from the group consisting of zinc oxide, zinc stannate, zinc carbonate, and tin oxide.

10. The flame retardant synthetic fiber according to claim 6, wherein the metal compound (2-2) is at least one selected from the group consisting of an antimonide, iron oxide, iron phosphate, iron oxalate, iron sulfide, molybdenum oxide, bismuth trioxide, bismuth oxychloride, and copper iodide.

11. The flame retardant synthetic fiber according to claim 10, wherein the metal compound (2-2) is an antimonide.

12. The flame retardant synthetic fiber according to claim 1, further comprising 0.1 to 20 parts by mass of the epoxy-containing compound, based on 100 parts by mass of the polymer (1).

13. The flame retardant synthetic fiber according to claim 1, wherein the polymer (1) contains 40 to 60 parts by mass of acrylonitrile, 60 to 30 parts by mass of a halogen-containing vinylidene monomer, and/or a halogen-containing vinyl monomer, and 0 to 10 parts by mass of a vinyl-based monomer copolymerizable therewith.

14. A flame retardant fiber composite, comprising a flame retardant synthetic fiber including: a polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer, and at least one kind of a metal compound (2) that accelerates a dehalogenation reaction of the polymer (1) during burning and a carbonization reaction of the polymer (1) during burning, wherein the flame retardant synthetic fiber has a shrinkage variation of 45% or less when a temperature is raised from 50° C. to 300° C. under a load of 0.0054 mN/dtex.

15. The flame retardant fiber composite according to claim 14, wherein the flame retardant fiber composite is a flame retardant fiber mixture containing 10% by mass or more of the flame retardant synthetic fiber, and 90% by mass or less of at least one kind of a fiber selected from the group consisting of a natural fiber, a regenerated fiber, and a synthetic fiber other than the flame retardant synthetic fiber.

16. The flame retardant fiber composite according to claim 15, wherein, in the flame retardant fiber mixture, the synthetic fiber other than the flame retardant synthetic fiber is a polyester fiber, and a content of the polyester fiber is 20% by mass or more.

17. A method for producing a flame retardant synthetic fiber, comprising spinning a composition that contains a polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer and that contains at least one kind of a metal compound (2) that accelerates a dehalogenation reaction of the polymer (1) during burning and a carbonization reaction of the polymer (1) during burning, followed by heat treatment, thereby obtaining a flame retardant synthetic fiber that has a shrinkage variation of 45% or less when a temperature is raised from 50° C. to 300° C. under a load of 0.0054 mN/dtex.

18. The method for producing a flame retardant synthetic fiber according to claim 17, wherein the composition is spun by extruding a spinning solution, followed by primary stretching, washing with water, drying, secondary stretching, and heat treatment, and a total stretching ratio obtained by multiplying a stretching ratio during the stretching by a relaxation ratio that is a ratio at which the fiber shrinks during the heat treatment is 4.5 times or less.

19. The method for producing a flame retardant synthetic fiber according to claim 17, wherein the heat treatment is relaxation heat treatment in dry-heating at 140° C. or higher or wet-heating at 90° C. or higher.

20. The method for producing a flame retardant synthetic fiber according to claim 17, wherein the composition contains 0.05 to 50 parts by mass of the metal compound (2), based on 100 parts by mass of the polymer (1).

21. A textile product comprising a flame retardant synthetic fiber including: a polymer (1) containing 30 to 70 parts by mass of acrylonitrile, 70 to 30 parts by mass of a halogen-containing vinylidene monomer and/or a halogen-containing vinyl monomer, and 0 to 10 parts by mass of a vinyl-based monomer copolymerizable therewith, based on 100 parts by mass of the polymer: and at least one kind of a metal compound (2) that accelerates a dehalogenation reaction of the polymer (1) during burning and a carbonization reaction of the polymer (1) during burning, wherein the flame retardant synthetic fiber has a shrinkage variation of 45% or less when a temperature is raised from 50° C. to 300° C. under a load of 0.0054 mN/dtex.

* * * * *